United States Patent [19]

Naruse et al.

[11] Patent Number: 5,070,003

[45] **Date of Patent: * Dec. 3, 1991**

[54] METHOD FOR PROCESSING SILVER HALIDE COLOR PHOTOGRAPHIC MATERIAL

[75] Inventors: Hideaki Naruse; Kazuaki Yoshida, both of Minami-ashigara, Japan

[73] Assignee: Fuji Photo Film Co., Ltd., Kanagawa, Japan

[ * ] Notice: The portion of the term of this patent subsequent to Apr. 2, 2008 has been disclaimed.

[21] Appl. No.: 416,802

[22] Filed: Oct. 3, 1989

[30] Foreign Application Priority Data

Oct. 3, 1988 [JP] Japan ..... 63-249234

[51] Int. Cl.[5] ..... G03C 7/32

[52] U.S. Cl. ..... 430/389; 430/376; 430/380; 430/382; 430/383; 430/467; 430/557; 430/963

[58] Field of Search ..... 430/389, 557, 380, 382, 430/376, 467, 963, 383

[56] References Cited

U.S. PATENT DOCUMENTS 4,830,955 6/1989 Kajiwara et al. ..... 430/505
4,851,326 7/1989 Ishikawa et al. ..... 430/380
4,853,321 8/1989 Momoki et al. ..... 430/380
4,880,728 11/1989 Ishikawa et al. ..... 430/380

FOREIGN PATENT DOCUMENTS 63-194261 8/1988 Japan ..... 430/557
63-309951 12/1988 Japan ..... 430/557
2037751A 7/1980 United Kingdom .

*Primary Examiner*—Charles L. Bowers, Jr.
*Assistant Examiner*—Janis L. Dote
*Attorney, Agent, or Firm*—Sughrue, Mion, Zinn, Macpeak & Seas

[57] ABSTRACT

There is disclosed a method for processing a silver halide color photographic material with a color developer containing at least one aromatic primary amine color-developing agent. In the method a silver halide color photographic material having at least one of the layers of which contains a silver halide emulsion of a high chloride comprising 80 mol % or over of silver chloride and the total coating amount of silver of which is 0.75 g/m$^2$ or below is processed, after exposure to light, with a color developer containing a specified amount of chloride ions and bromide ions. The silver halide color photographic material contains at least one of yellow couplers specified.

16 Claims, No Drawings

METHOD FOR PROCESSING SILVER HALIDE COLOR PHOTOGRAPHIC MATERIAL

FIELD OF THE INVENTION

The present invention relates to a method for processing a silver halide color photographic material, and more particularly a development processing method that uses a silver halide color photographic material having a high silver chloride content (hereinafter referred to as a high-silver-chloride color photographic material), which is improved in development characteristics and is excellent in desilvering ability.

BACKGROUND OF THE INVENTION

In recent years in the photographic processing of color photographic materials, with the shortening of the time of delivery of finished goods and the reduction of labor in laboratories, it is desired to shorten the processing time. To accomplish this, while generally the temperature or the replenishing amount is increased, other various techniques have also been proposed, such as the intensification of stirring or the addition of various accelerators.

Among others, for the purpose of making the color development rapid and/or of reducing the replenishing amount, it is known to use a method wherein a color photographic material containing a silver chloride emulsion, instead of the conventionally widely used silver bromide type emulsions or silver iodide emulsions, is processed. For example, in International Publication No. WO-87-04534, a method is described for rapidly processing a high-silver-chloride color photographic material with a color developer substantially free from sulfite ions and benzyl alcohol.

However, it has been found that when development processing is carried out by an automatic processor for papers according to the above method, streaked fogging occurs. This is assumed to occur as follow: when the photographic material comes in contact with a roller or the like in the developing tank of an automatic processor, the photographic material becomes scarred and is pressure-sensitized, resulting in streaked fogging due to the pressure sensitization, that is, so-called insolution pressure-sensitized streaks (hereinafter referred to as pressure-sensitized streaks) occur.

Further, facts have been apparent that when the method is used for continuous processing, fluctuation of photographic quality, in particular fluctuation of the minimum density (Dmin) and the maximum density (Dmax), becomes conspicuous, and insufficient desilvering takes place such that the white background is greatly stained.

Thus, rapid development processing that uses a high-silver-chloride color photographic material is accompanied by such serious problems as pressure-sensitized streaks, fluctuation of the photographic quality, and the occurrence of insufficient desilvering, and therefore such processing could not be practically used.

Of the above problems, the fluctuation of photographic quality in continuous processing, in particular the fluctuation of photographic quality in a yellow image-forming layer, is a serious problem.

On the other hand, although, as a conventional yellow coupler, four-equivalent couplers or α-acylacetanilides, one of the hydrogen atoms of the active methylene group of which is substituted, for example, by an aryloxy group, a halogen atom, a sulfoxy group, or an acyloxy group, are known, as described in JP-A ("JP-A" means unexamined published Japanese patent application) No. 87650/1975 and British Patent Nos. 3,369,695, 3,408,194, 3,415,652, and 3,447,928, these couplers had such defects as insufficient coupling reactivity and conspicuous color fogging, that would result from their use.

As more active yellow couplers that overcome these defects, couplers are known that are described in JP-A No. 26133/1972 and JP-B ("JP-B" means examined Japanese patent publication) No. 44420/1981, wherein a nitrogen-atom-containing heterocyclic ring is substituted directly for one of the hydrogen atoms of the active methylene group, and although it is recognized that they are improved in comparison with prior couplers, the effect was insufficient.

Further, in a rapid process that uses a high-silver-chloride color photographic material, in order to reduce the fluctuation of photographic quality, in particular the fluctuation of minimum density (Dmin), involved in continuous processing, the use of organic antifoggants is known, as described in JP-A Nos. 95345/1983 and 23342/1984. However, it has been found that the use of the organic antifoggants prevents neither the occurrence of pressure-sensitized streaks, as mentioned above, nor the increase of Dmin involved in continuous processing, and it has also been found that the occurrence of insufficient desilvering involved in continuous processing further increases.

JP-A No. 70552/1986 describes a process for lowering the replenishing amount of a developer, wherein a high-silver-chloride color photographic material is used and a replenisher is added in such an amount that overflow to the developing bath will not take place during the development processing, while JP-A No. 106655/1988 describes a process for processing a high-silver-chloride color photographic material with a color developer containing a hydroxylamine compound and a chloride, in a certain concentration or over, to stabilize the processing. However, these methods cannot practically be used because of pressure-sensitized streaks occurring in a process using an automatic processor, the fluctuation of photographic quality in continuous processing, and the occurrence of insufficient desilvering.

Thus, since in the prior art the problem of pressure-sensitized streaks occurring in a process using an automatic processor has not been taken into consideration, and an attempt to solve the problem has not been made, it is desired to minimize pressure-sensitized streaks.

Further, a technique is strongly desired for solving the fluctuation of photographic quality in continuous processing, in particular the fluctuation of photographic quality of the yellow image, and the problem of pressure-sensitized streaks, without bringing about insufficient desilvering.

BRIEF SUMMARY OF THE INVENTION

Therefore, the first object of the present invention is to provide a rapid processing method that uses a high-silver-chloride photographic material, that is improved in prevention of pressure-sensitized streaks, and that exhibits stable photographic quality even in continuous processing.

The second object of the present invention is to provide a processing method for color-developing using a high-silver-chloride color photographic material that will result in a lower amount of residual silver, and that is improved in bleach ability.

The above and other objects, features, and advantages of the invention will become apparent in the following detailed description.

DETAILED DESCRIPTION OF THE INVENTION

The above objects have been accomplished by providing a processing method described below.

That is, the present invention provides a method for processing a silver halide color photographic material with a color developer that contains at least one aromatic primary amine color-developing agent, characterized in that said silver halide color photographic material includes a layer containing a silver halide emulsion made up of 80 mol % or over of silver chloride and at least one yellow coupler represented by the following formula (I):

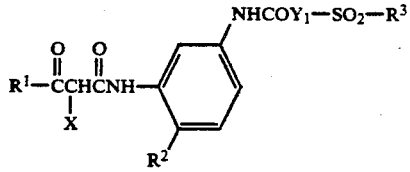

Formula (I)

wherein $R^1$ represents a tertiary alkyl group or an aryl group, $R^2$ represents a halogen atom or an alkoxy group, $R^3$ represents an alkyl group or an aryl group, $Y_1$ represents a divalent linking group, and X represents a coupling split-off group, and having the total coated amount of silver of 0.75 g/m$^2$ or below, with said color developer contains chloride ions in an amount of $3.5\times10^{-2}$ to $1.5\times10^{-1}$ mol/l, and bromide ions in an amount of $3.0\times10^{-5}$ to $1.0\times10^{-3}$ mol/l.

The compounds represented by formula (I) of the present invention are described in more detail below.

In formula (I), the tertiary alkyl group represented by $R^1$ includes unsubstituted alkyl groups (e.g., t-butyl) and substituted alkyl groups (preferably, the number of carbon atoms in total is 4 to 10). The substituent introduced in the alkyl group includes, for example, halogen atoms (e.g., fluorine, chlorine, and bromine), alkoxy groups (e.g., methoxy and ethoxy), aryloxy groups (e.g., phenoxy and 4-chlorophenoxy), alkylthio groups (e.g., methylthio and n-butylthio), arylthio groups (e.g., phenylthio), alkylsulfonyl groups (e.g., methanesulfonyl and n-butanesulfonyl), arylsulfonyl groups (e.g., benzenesulfonyl and 4-methoxybenzenesulfonyl), acylamino groups (e.g., acetylamino), amino groups (e.g., diethylamino), and a cyano group. The aryl group represented by $R^1$ is preferably a phenyl group that may be substituted. As the substituent of the aryl group can be mentioned those substituents mentioned for the above alkyl group, and, for example, an alkyl group (e.g., methyl, ethyl, and n-butyl).

$R^2$ is preferably a chlorine atom or an alkoxy group (preferably, the number of carbon atoms is 1 to 20, e.g., methoxy and ethoxy).

The alkyl group represented by $R^3$ includes unsubstituted alkyl groups (e.g., n-octyl, n-dodecyl, and n-heptadecyl) and substituted alkyl groups (preferably, the number of carbon atoms in total is 1 to 20).

As the substituent introduced in by the above alkyl group can be mentioned, for example, those substituents mentioned for $R^1$.

The aryl group represented by $R^3$ is preferably a phenyl group that may be substituted or unsubstituted.

As the substituent that may be introduced in the phenyl group can be mentioned those substituents mentioned for the above alkyl group, and, for example, alkyl groups (e.g., methyl and ethyl).

$Y_1$ represents a divalent linking group including an alkylene group (preferably, the number of carbon atoms is 2 to 6), an arylene group (preferably, the number of carbon atoms is 6 to 20), an aralkylene group (preferably, the number of carbon atoms is 8 to 20), or a divalent organic group represented by the following formula (I-a):

-A-V-B- Formula (I-a)

wherein A and B each represent an alkylene group, an arylene group, or an aralkylene group that may have a substituent, and V represents a divalent crosslinking group. As the substituent of A and B can be mentioned those substituents mentioned for $R^1$. For example, V represents an oxy group, a thio group, a carboxide group, and a sulfonamido group.

The coupling split-off group represented by X is preferably a coupling split-off group to form a two-equivalent yellow coupler, for example a group represented by the following formula (a), (b), or (c):

Formula (a)

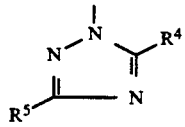

Formula (b)

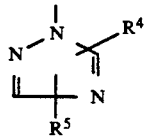

wherein $R^4$ and $R^5$, which may be the same or different, each represent a hydrogen atom, a halogen atom, a carboxylic acid ester group, an amino group, an alkyl group, an alkylthio group, an alkoxy group, an alkylsulfonyl group, an alkylsulfinyl group, a carboxylic acid group, a sulfonic acid group, a substituted or unsubstituted phenyl group, or a heterocyclic group.

Formula (c)

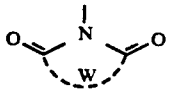

wherein $W^1$ represents a group of nonmetal atoms required to form a 4-, 5-, or 6-membered ring together with

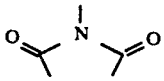

in the formula.

More preferably the group is represented by (d), (e), or (f) given below.

Formula (d)

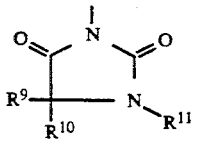

Formula (e)

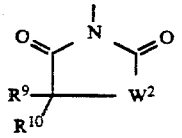

-continued

Formula (f)

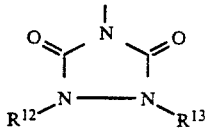

wherein $R^9$, and $R^{10}$ each represent a hydrogen atom, an alkyl group, an aryl group, an alkoxy group, an aryloxy group, or a hydroxy group, $R^{11}$, $R^{12}$, and $R^{13}$ each represent a hydrogen atom, an alkyl group, an aryl group, an aralkyl group, or an acyl group, and $W^2$ represents an oxygen atom or a sulfur atom.

Now, specific examples of the coupler used in the present invention are given below, but the couplers of the present invention are not limited to them.

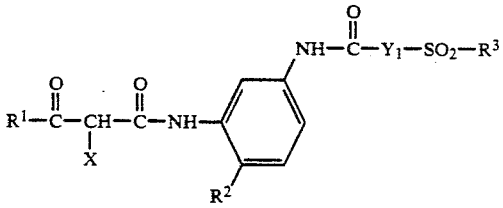

| No. | $R^1$ | $R^2$ | $R^3$ | $Y_1$ | X |
|---|---|---|---|---|---|
| 1 | $(CH_3)_3C-$ | Cl | $(n)C_{12}H_{25}-$ | $-CH(CH_3)-CH_2-$ | 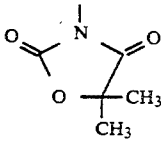 |
| 2 | " | " | " | " | 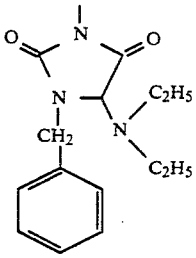 |
| 3 | " | " | " | $-CH_2CH_2-$ | " |
| 4 | " | " | " | $-CH(CH_3)-CH_2-$ | 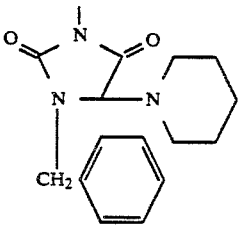 |
| 5 | " | " | $(n)C_{16}H_{33}-$ | " | 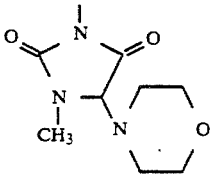 |
| 6 | " | " | " | $-CH_2CH_2-$ | " |
| 7 | " | " | " | $-CH_2CH_2CH_2-$ | " |

-continued
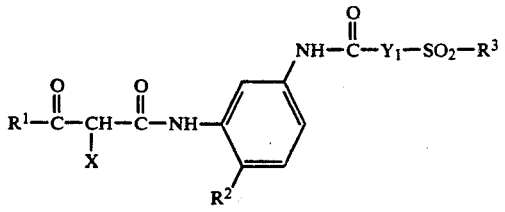
| No. | $R^1$ | $R^2$ | $R^3$ | $Y_1$ | X |
|---|---|---|---|---|---|
| 8 | " | " | " | 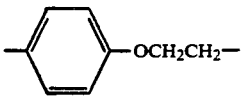 | 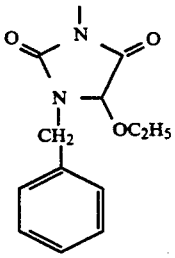 |
| 9 | " | " | " | $-CH(CH_3)-CH_2-$ | " |
| 10 | " | " | " | $-CH_2CH_2-$ | " |
| 11 | $(CH_3)_3C-$ | Cl | $nC_{12}H_{25}$ | $-CH(CH_3)-CH_2-$ | 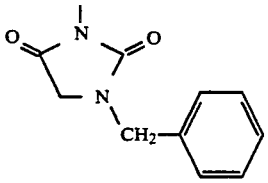 |
| 12 | $(CH_3)_3C-$ | Cl | $nC_{12}H_{25}$ | $-CH_2-CH_2-$ | 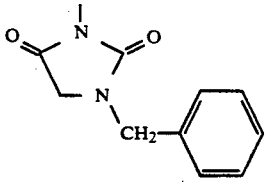 |
| 13 | " | $OCH_3$ | " | " | " |
| 14 | $CH_3CH_2CH_2C(Me)_2-$ | Cl | " | " | " |
| 15 | $(CH_3)_3$ | Cl | " | $-CH(CH_3)-CH_2-$ | 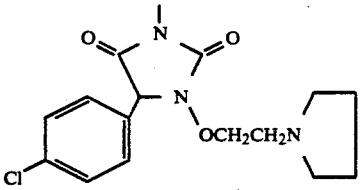 |
| 16 | " | " | " | " | 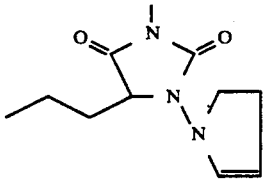 |

-continued

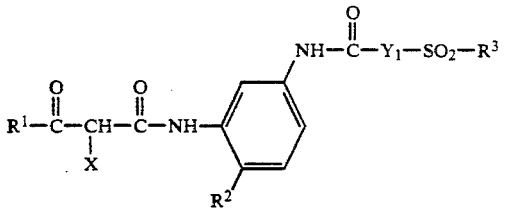

| No. | $R^1$ | $R^2$ | $R^3$ | $Y_1$ | X |
|---|---|---|---|---|---|
| 17 | " | " | " | | 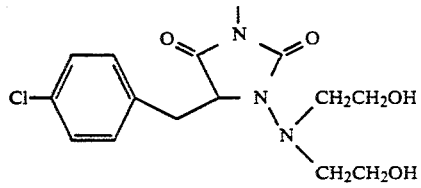 |
| 18 | 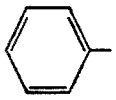 | " | " | " | " |
| 19 | 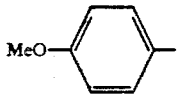 | " | " | " | " |
| 20 | " | " | " | " | 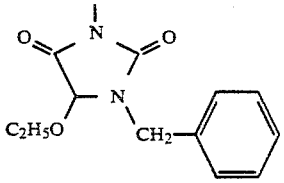 |
| 21 | " | " | " | " | 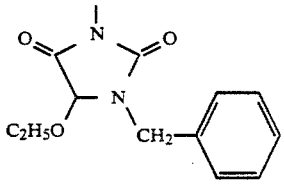 |
| 22 | " | " | " | " | 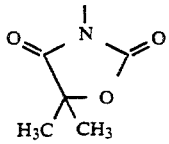 |

As the yellow coupler represented by formula (I) of the present invention other than the above those described in JP-B No. 44420/1981 can be mentioned.

The amount of yellow coupler represented by formula (I) to be added is preferably 0.001 to 1 mol, more preferably 0.01 to 0.5 mol, most preferably 0.1 to 0.5 mol, per mol of silver halide.

In the present invention, in addition to the yellow coupler represented by formula (I), various couplers can also be used, and specific examples thereof are described in patents cited in Research Disclosure (RD) No. 17643, VII-C to G mentioned above.

As a yellow coupler to be used in combination with the yellow coupler represented by formula (I), preferably use can be made of one described, for example, in U.S. Pat. Nos. 3,933,501, 4,022,620, 4,326,024, 4,401,752, and 4,248,961, JP-B No. 10739/1983, British Patent Nos. 1,425,020, and 1,476,760, U.S. Pat. Nos. 3,973,968, 4,314,023, and 4,511,649, and European Patent 249,473A.

As magenta couplers, the 5-pyrazolone type and pyrazoloazole type are preferable, and those described, for example, in U.S. Pat. Nos. 4,310,619 and 4,351,897, European Patent No. 73,636, U.S. Pat. Nos. 3,061,432 and 3,725,067, Research Disclosure No. 24220 (June 1984), JP-A No. 33552/1985, Research Disclosure No. 24230 (June 1984), JP-A Nos. 43659/1985, 72238/1986, 35730/1985, 118034/1980, and 185951/1985, U.S. Pat.

Nos. 4,500,630, 4,540,654, and 4,556,630, and WO(PCT) No. 88/04795 are particularly preferable.

As cyan couplers can be mentioned phenol series couplers and naphthol series couplers, and those described, for example, in U.S. Pat. Nos. 4,052,212, 4,146,396, 4,228,233, 4,296,200, 2,369,929, 2,801,171, 2,772,162, 2,895,826, 3,772,002, 3,758,308, 4,334,011, and 4,327,173, West German Patent Application (OLS) No. 3,329,729, European Patent Nos. 121,365A and 249,453A, U.S. Pat. Nos. 3,446,622, 4,333,999, 4,753,871, 4,451,559, 4,427,767, 4,690,889, 4,254,212, and 4,296,199, and JP-A Nos. 42658/1986 are preferable.

As a colored coupler to correct the undesired absorption of color-forming dyes, those couplers described in paragraph VII-G of Research Disclosure No. 17643, U.S. Pat. No. 4,165,670, JP-B No. 39413/1982, U.S. Pat. Nos. 4,004,929 and 4,138,258, and British Patent No. 1,146,368 are preferable.

As a coupler which forms a dye having proper diffusibility, those described in U.S. Pat. No. 4,366,237, British Patent No. 2,125,570, European Patent No. 96,570, and West German Patent Application (OLS) No. 3,234,533, are preferable.

Typical examples of a polymerized dye-forming coupler are described in U.S. Pat. Nos. 3,451,820, 4,080,211, 4,367,282, 4,409,320, and 4,576,910, and British Patent No. 2,102,173.

A coupler that releases a photographically useful residue can be used favorably in this invention. As a DIR coupler that releases a development retarder, those described in patents cited in paragraph VII-F of the above-mentioned Research Disclosure No. 17643, JP-A Nos. 151944/1982, 154234/1982, 184248/1985, and 37346/1988, and U.S. Pat. No. 4,248,962 are preferable.

As a coupler which releases, imagewise, a nucleating agent or a development accelerator upon developing, those described in British Patent Nos. 2,097,140 and 2,131,188, and JP-A Nos. 157638/1984 and 170840/1984 are preferable.

Other couplers that can be incorporated in the photographic material of the present invention include competitive couplers described in U.S. Pat. No. 4,130,427, multiequivalent couplers described in U.S. Pat. Nos. 4,283,472, 4,338,393, and 4,310,618, couplers that release a DIR coupler redox compound or a DIR coupler, as described, for example, in JP-A Nos. 185950/1985 and 24252/1987, couplers that release a dye to regain a color after releasing, as described in European Patent No. 173,302A, couplers that release a bleach-accelerator, as described in RD Nos. 11449 and 24241, and JP-A No. 201247/1066, couplers that release a ligand, as described in U.S. Pat. No. 4,553,477 and couplers that release a leuco dye, as described in JP-A No. 75747/1988.

Couplers for use in the present invention can be introduced into a photographic material by any one of various known dispersing methods.

Examples of high-boiling organic solvents are described in U.S. Pat. No. 2,322,027.

Examples of high boiling organic solvents having a boiling point of 175° C. or higher at the normal pressure include phthalic esters (e.g., dibutyl phthalate, dicyclohexyl phthalate, di-2-ethylhexyl phthalate, decyl phthalate, bis(2,4-di-t-amylphenyl)phthalate, bis(2,4-di-t-amylphenyl)isophthalate, and bis(1,1-diethylpropyl) phthalate), phosphoric or phosphonic esters (e.g., triphenyl phosphate, tricresyl phosphate, 2-ethylhexyldiphenyl phosphate, tricyclohexyl phosphate, tri-2-ethylhexyl phosphate, tridodecyl phosphate, tributoxyethyl phosphate, trichloropropyl phosphate, and di-2-ethylhexylphenyl phosphonate), benzoic esters (e.g., 2-ethylhexyl benzoate, dodecyl benzoate, and 2-ethylhexyl-p-hydroxy benzoate), amides (e.g., N,N-diethyldodecanamide, N,N-diethyllaurylamide, and N-tetradecylpyrrolidone), alcohols or phonols (e.g., isostearyl alcohol and 2,4-di-tert-amylphonol), aliphatic carboxylic esters (e.g., bis(2-ethylhexyl)sebacate, dioctylazelate, glycerol tributyrate, isosteraryl lactate, and trioctyl citrate), aniline derivatives (e.g., N,N-dibutyl-2-butoxy-5-tert-octyl-aniline), and hydrocarbons (e.g., paraffin, dodecylbenzene, and diisopropylnaphthalene). The auxiliary solvents are organic solvents having a boiling point higher than about 30° C., preferably from about 50° C. to below about 160° C. Examples of these solvents include ethyl acetate, butyl acetate, ethyl propionate, methylethyl ketone, cyclohexanone, 2-ethoxyethyl acetate, and dimethylformamide.

The steps and effect of the latex dispersion method and the examples of latex for impregnation are disclosed in U.S. Pat. No. 4,199,363 and West German Patent Application (OLS) Nos. 2,541,274 and 2,541,230.

The high-silver-chloride color photographic material of the present invention can be constituted by applying at least each of a blue-sensitive silver halide emulsion layer, a green-sensitive silver halide emulsion layer, and a red-sensitive silver halide emulsion layer on a base. For common color print papers, the above silver halide emulsion layers are applied in the above-stated order on the base, but the order may be changed. Color reproduction by the subtractive color process can be performed by incorporating, into these photosensitive emulsion layers, silver halide emulsions sensitive to respective wavelength ranges, and so-called couplers capable of forming dyes complementary to light to which the couplers are respectively sensitive, that is, capable of forming yellow complementary to blue, magenta complementary to green, and cyan complementary to red. However, the constitution may be such that the photosensitive layers and the color formed from the couplers do not have the above relationship.

As the silver halide emulsion of the present invention, a emulsion of high silver chloride content, so-called a high-silver-chloride emulsion may be used. The content of silver chloride is 80 mol % or over, preferably 95 mol % or over, more preferably 98 mol % or over.

As the silver halide emulsion used in the present invention, one comprising silver chlorobromide or silver chloride and being substantially free from silver iodide can be preferably used. Herein the term "substantially free from silver iodide" means that the silver iodide content is 1 mol % or below, and preferably 0.2 mol % or below. Although the halogen compositions of the emulsions may be the same or different from grain to grain, if emulsions whose grains have the same halogen composition are used, it is easy to make the properties of the grains homogeneous. With respect to the halogen composition distribution in a silver halide emulsion grain, for example, a grain having a so-called uniform-type structure, wherein the composition is uniform throughout the silver halide grain, a grain having a so-called layered-type structure, wherein the halogen composition of the core of the silver halide grain is different from that of the shell (which may comprises a single layer or layers) surrounding the core, or a grain having a structure with nonlayered parts different in halogen composition in the grain or on the surface of the grain (if the nonlayered parts are present on the surface of the grain, the structure has parts different in halogen composition joined onto the edges, the corners, or the planes of the grain) may be suitably selected and used. To secure high sensitivity, it is more advantageous to use either of the latter two than to use grains having a uniform-type structure, which is also preferable in view of the pressure resistance. If the silver halide grains have the above-mentioned structure, the boundary section between parts different in halogen composition may be a clear boundary, or an unclear boundary, due to the formation of mixed crystals caused by the difference in composition, or it may have positively varied continuous structures.

In these high-silver-chloride emulsions, the structure is preferably such that the silver bromide localized layer in the layered form or nonlayered form is present in the silver halide grain and/or on the surface of the silver halide grain as mentioned above. The silver bromide content of the composition of the above-mentioned localized layer is preferably at least 10 mol %, and more preferably over 20 mol %. The localized layer may be present in the grain, or on the edges, or corners of the grain surfaces, or on the planes of the grains, and a preferable example is a localized layer epitaxially grown on each corner of the grain.

On the other hand, for the purpose of suppressing the lowering of the sensitivity as much as possible when the photographic material undergoes pressure, even in the case of high-silver-chloride emulsions having a silver chloride content of 90 mol % or over, it is preferably also practiced to use grains having a uniform-type structure, wherein the distribution of the halogen composition in the grain is small.

In order to reduce the replenishing amount of the development processing solution, it is also effective to increase the silver chloride content of the silver halide emulsion. In such a case, an emulsion whose silver chloride is almost pure, that is, whose silver chloride content is 98 to 100 mol %, is also preferably used.

The average grain size of the silver halide grains contained in the silver halide emulsion used in the present invention (the diameter of a circle equivalent to the projected area of the grain is assumed to be the grain size, and the number average of grain sizes is assumed to be an average grain size) is preferably 0.1 to 2 μm.

Further, the grain size distribution thereof is preferably one that is a so-called monodisperse dispersion, having a deviation coefficient (obtained by dividing the standard deviation of the grain size by the average grain size) of 20% or below, and desirably 15% or below. In this case, for the purpose of obtaining one having a wide latitude, it is also preferable that monodisperse emulsions as mentioned above are blended to be used in the same layer, or are applied in layers.

As to the shape of the silver halide grains contained in the photographic emulsion, use can be made of grain in a regular crystal form, such as cubic, tetradecahedral, or octahedral, or grains in an irregular crystal form, such as spherical or planar, or grains that are a composite of these. Also, a mixture of silver halide grains having various crystal forms can be used. In the present invention, of these, grains containing grains in a regular crystal form in an amount of 50% or over, preferably 70% or over, and more preferably 90% or over, are preferred.

Further, besides those mentioned above, an emulsion wherein the tabular grains having an average aspect ratio (the diameter of a circle calculated/the thickness) of 5 or over, and preferably 8 or over, exceed 50% of the total of the grains in terms of the projected area, can be preferably used.

The silver chloromide emulsion used in the present invention can be prepared by methods described, for example, by P. Glafkides, in *Chimie et Phisique Photographique* (published by Paul Montel, 1967), by G. F. Duffin in *Photographic Emulsion Chemistry* (published by Focal Press, 1966), and by V. L. Zelikman et al. in *Making and Coating Photographic Emulsion* (published by Focal Press, 1964). That is, any of the acid process, the neutral process, the ammonia process, etc. can be used, and to react a soluble silver salt and a soluble halide, for example, any of the single-jet process, the double-jet process, or a combination of these can be used. A process of forming grains in an atmosphere having excess silver ions (the so-called reverse precipitation process) can also be used. A process wherein the pAg in the liquid phase where a silver halide is to be formed is kept constant, that is, the so-called controlled double-jet process, can be used as one type of double-jet process. According to the controlled double-jet process, a silver halide emulsion wherein the crystal form is regular and the grain sizes are nearly uniform can be obtained.

Into the silver halide emulsion used in the present invention, various polyvalent metal ion impurities can be introduced during the formation or physical ripening of the emulsion grains. Examples of such compounds to be used include salts of cadmium, zinc, lead, copper, and thallium, and salts or complex salts of an element of Group VIII, such as iron, ruthenium, rhodium, palladium, osmium, iridium, and platinum. Particularly the elements of Group VIII can be preferably used. Although the amount of these compounds to be added varies over a wide range according to the purpose, preferably the amount is $10^{-9}$ to $10^{-2}$ mol for the silver halide.

The silver halide emulsion used in the present invention is generally chemically sensitized and spectrally sensitized.

With respect to the chemical sensitization, sulfur sensitization, wherein typically an unstable sulfur compound is added, noble metal sensitization—typically gold sensitization—or reduction sensitization, can be used alone or in combination. With respect to compounds used in the chemical sensitization, it is preferable to use those described in JP-A No. 215372/1987, in the lower right column on page 18 to the upper right column on page 22.

Spectral sensitization is performed for the emulsions of the layers of the present photographic material, so as to provide the emulsions with spectral sensitivities in the desired light wavelength ranges. In the present invention, it is preferable to add a dye for absorbing light in the wavelength range corresponding to the intended spectral sensitivity, that is, a spectral-sensitizing dye. As the spectral-sensitizing dye used, hose described, for example, by F. M. Harmer in *Heterocyclic Compounds—Cyanine Dyes and Related Compounds* (published by John Wiley & Sons (New York, London), 1964) can be mentioned. Examples of specific compounds are preferably those described in the above-mentioned JP-A No. 215272/1987, page 22 (the upper right column) to page 38.

The silver halide emulsion used in the present invention may contain various compounds or their precursors to prevent fogging during photographic processing, storage, or the manufacturing process of the photographic material, or to stabilize the photographic performance. These are generally referred to as photographic stabilizers. Examples of these compounds to be used preferably include those described on pages 39 to 72 of the above-mentioned JP-A No. 215272/1987.

Silver halide emulsions for use in the present invention may be a so-called surface latent-image-type emulsion, which forms a latent image primarily on the grain surface or a so-called interior latent-image-type emulsion, which forms a latent image primarily in the interior of the grains.

The total coating amount of silver in the high-silver-chloride color photographic material of the present invention is preferably 0.3 to 0.75 g/m$^2$, more preferably 0.40 to 0.65 g/m$^2$. Dmax is excellent in the preferable coating amount range of silver halide. When the total coating amount of silver is over 0.75 g/m$^2$, the purpose of the present invention is not attained, since the fluctuation of photographic characteristics during a continuous processing becomes large and the residual silver after processing becomes large.

Known photographic additives including those to be used in preparing an emulsion that can be used in the present invention are described in Research Disclosure No. 17643 and ibid. No. 18716, and the involved sections are listed in the following Table.

| | Additive | RD 17643 | RD 18716 |
|---|---|---|---|
| 1 | Chemical sensitizer | p. 23 | p. 648 (right column) |
| 2 | Sensitivity-enhancing agents | " | " |
| 3 | Spectral sensitizers, Supersensitizers | pp. 23–24 | pp. 648 (right column)–649 (right column) |
| 4 | Brightening agents | p. 24 | — |
| 5 | Antifogging agents and Stabilizers | pp. 24–25 | p. 648 (right column) |
| 6 | Light absorbers, Filter dyes and UV absorbers | pp. 25–26 | pp. 649 (right column)–650 (right column) |
| 7 | Stain-preventive agents | p. 25 (right column) | p. 650 (left to right (column) |
| 8 | Image-dye stabilizers | p. 25 | — |
| 9 | Hardeners | p. 26 | p. 651 (left column) |
| 10 | Binders | p. 26 | " |
| 11 | Plasticizers and Lubricants | p. 27 | p. 650 (right column) |
| 12 | Coating aids and Surface-active agents | pp. 26–27 | " |
| 13 | Antistatic agents | p. 27 | " |

The photographic material that is prepared according to the present invention may contain, as a color antifoggant, for example, a hydroquinone derivative, an aminophenol derivative, a gallic acid derivative, or an ascorbic acid derivative.

In the photographic material of the present invention, various anti-fading agents (discoloration preventing agents) can be used. As organic anti-fading agents for cyan, magenta, and/or yellow images, typical examples are hydroquinones, 6-hydroxychromans, 5-hydroxycoumarans, spirochromans, p-alkoxyphenols, hindered phenols, including bisphenols, gallic acid derivatives, methylenedioxybenzenes, aminophenols, and hindered amines, and ether or ester derivatives thereof, obtained by silylating or alkylating the phenolic hydroxyl group of these compounds. Metal complexes such as (bis-salicylaldoxymato)nickel complexes, and (bis-N,N-dialkyldithiocarbamato)nickel complexes can also be used.

Specific examples of organic anti-fading agents are described in the following patent specifications.

Hydroquinones are described, for example, in U.S. Pat. Nos. 2,360,290, 2,418,613, 2,700,453, 2,701,197, 2,728,659, 2,732,300, 2,735,765, 3,982,944, and 4,430,425, British Patent No. 1,363,921, and U.S. Pat. Nos. 2,710,801 and 2,816,028; 6-hydroxychromans, 5-hydroxycoumarans, and spirochromans are described, for example, in U.S. Pat. Nos. 3,432,300, 3,573,050, 3,574,627, 3,698,909, and 3,764,337, and JP-A No. 152225/1987; spiroindanes are described, for example, in U.S. Pat. No. 4,360,589; p-alkoxyphenols are described, for example, in U.S. Pat. No. 2,735,765, British Patent No. 2,066,975, JP-A No. 10539/1984, and JP-B No. 19765/1982; hindered phenols are described, for example, in U.S. Pat. No. 3,700,455, JP-A No. 72224/1977, U.S. Pat. No. 4,228,235, and JP-B No. 6623/1977; gallic acid derivatives, methylenedioxybenzenes, and aminophenols are described, for example, in U.S. Pat. Nos. 3,457,079, and 4,332,886, and JP-B No. 21144/1981, respectively; hindered amines are described, for example, in U.S. Pat. Nos. 3,336,135, and 4,268,593, British Patent Nos. 1,326,889, 1,354,313, and 1,410,846, JP-B No. 1420/1976, and JP-A Nos. 114036/1983, 53846/1984, and 78344/1984; ether and ester derivatives obtained by silylating or alkylating their phenolic hydroxyl group are described, for example, in U.S. Pat. Nos. 4,155,765, 4,174,220, 4,254,216, and 4,264,720, JP-A No. 145530/1979, 6321/1980, 105147/1983, and 10539/1984, JP-B No. 37856/1982, U.S. Pat. No. 4,279,990, and JP-B No. 3263/1978; and metal complexes are described, for example, in U.S. Pat. No. 4,050,938 and 4,241,155, and British Patent No. 2,027,731 (A). These compounds are coemulsified with respective couplers, generally in amounts of 5 to 100 wt. % for respective couplers, and are added to photosensitive layers to attain the purpose. To prevent the cyan dye image from being deteriorated by heat and light, it is more effective that an ultraviolet-absorbing agent is introduced into the layers opposites to the cyan color-forming layer.

Of these anti-fading agents, spiroindanes and hindered amines are particularly preferable.

In the present invention, together with the above couplers, in particular together with the pyrazoloazole coupler, the following compounds are preferably used.

That is, it is preferred that a compound (F), which will chemically bond to the aromatic amide developing agent remaining after the color-developing process, to form a chemically inactive and substantially colorless compound, and/or a compound (G), which will chemically bond to the oxidized product of the aromatic amide color developing agent remaining after the color-developing process, to form a chemically inactive and substantially colorless compound, are used simultaneously or separately, for example, to prevent the occurrence of stain due to the formation of a color-developed dye by the reaction of the couplers with the color-developing agent remaining in the film during storage after the processing or with the oxidized product of the color-developing agent, and to prevent other side effects.

Preferable as compound (F) are those that can react with p-anisidine a the second-order reaction-specific rate k2 (in trioctyl phosphate at 80° C.) in the range of 1.0 l/mol·sec to $1\times10^{-5}$ l/mol·sec. The second-order reaction-specific rate can be determined by the method described in JP-A No. 158545/1983.

If k2 is over this range, the compound itself becomes unstable, and in some cases the compound reacts with gelatin or water to decompose. On the other hand, if k2 is below this range, the reaction with the remaining aromatic amine developing agent becomes slow, resulting, in some cases, in the failure to prevent the side effects of the remaining aromatic amine developing agent, which prevention is aimed at by the present invention.

More preferable as compound (F) are those that can be represented by the following formula (FI) or (FII):

$$R'_1\text{-}(A)n\text{-}X' \qquad \text{Formula (FI)}$$

$$R'_2-\underset{\underset{B}{|}}{C}=Y \qquad \text{Formula (FII)}$$

wherein $R'_1$ and $R'_2$ each represent an aliphatic group, an aromatic group, or a heterocyclic group, n is 1 or 0, A represents a group that will react with an aromatic amine developing agent to form a chemical bond therewith, X' represents a group that will react with the aromatic amine developing agent and split off, B represents a hydrogen atom, an aliphatic group, an aromatic group, a heterocyclic group, an acyl group, or a sulfonyl group, Y represents a group that will facilitate the addition of the aromatic amine developing agent to the compound represented by formula (II), and $R'_1$ and X', or Y and $R'_2$ or B, may bond together to form a ring structure.

Of the processes wherein compound (F) bonds chemically to the remaining aromatic amine developing agent, typical processes are a substitution reaction and an addition reaction.

Specific examples of the compounds represented by formulae (FI), and (FII) are described, for example, in JP-A Nos. 158545/1988, 28338/1987, 2042/1989, and 86139/1989.

On the other hand, more preferable examples of compound (G), which will chemically bond to the oxidized product of the aromatic amine developing agent remaining after color development processing, to form a chemically inactive and colorless compound, can be represented by the following formula (GI):

$$R\text{-}Z \qquad \text{Formula (GI)}$$

wherein R represents an aliphatic group, an aromatic group, or a heterocyclic group, Z represents a nucleophilic group or a group that will decompose in the photographic material to release a nucleophilic group. Preferably the compounds represented by formula (GI) are ones wherein Z represents a group whose Pearson's nucleophilic $^{n}CH_3I$ value (R. G. Pearson, et al., *J. Am. Chem. Soc.*, 90, 319 (1968)) is 5 or over, or a group derived therefrom.

Specific examples of compounds represented by formula (GI) are described, for example, in European Published Patent No. 255722, JP-A Nos. 143048/1987, 229145/1987, and 86139/1989, Japanese Patent Application No. 136724/1988, and JP-A Nos. 57259/1989 and 2042/1989.

Details of combinations of compound (G) and compound (F) are described in JP-A No. 86139/1989.

Similarly, for the purpose of preventing the occurrence of stain and other side effects due to the formation of a color-developed dye by the reaction of a coupler with the color-developing agent remaining in the film or the oxidized product of the color-developing agent during storage after the processing, it is preferable to use an amine compound. Preferable amine compounds can be represented by the following formula (FG):

$$\begin{array}{c} R_{00} \diagdown \quad \diagup R_{01} \\ N \\ | \\ R_{02} \end{array} \qquad \text{Formula (FG)}$$

wherein $R_{00}$ represents a hydrogen atom, a hydroxy group, an alkoxy group, an acyloxy group, a sulfonyloxy group, a substituted or unsubstituted amino group, an alkoxy group, an aryloxy group, a heterocyclic oxy group, an aliphatic group, an aromatic group, an aromatic group, or a heterocyclic group, $R_{01}$ represents a hydrogen atom, an aliphatic group, an aromatic group, or a heterocyclic group, $R_{02}$ represents an aliphatic group, an aromatic group, or a heterocyclic group, and at least two groups of $R_{00}$, $R_{01}$, and $R_{02}$ may bond together to form a monocyclic or polycyclic heterocyclic ring.

Specific examples of compounds represented by formula (FG) are described, for example, in U.S. Pat. Nos. 4,483,918, 4,555,479, and 4,585,728, and JP-A No. 102231/1983 and 229557/1984.

The photographic material prepared in accordance with the present invention may contain, in the hydrophilic colloid layer, an ultraviolet absorber. For example, benzotriazole compounds substituted by an aryl group (e.g., those described in U.S. Pat. No. 3,533,794), 4-thiazolidone compounds (e.g., those described in U.S. Pat. Nos. 3,314,794 and 3,352,681), benzophenone compounds (e.g., those described in JP-A No. 2784/1971), ester compounds of cinnamic acid (e.g., those described in U.S. Pat. Nos. 3,705,805 and 3,707,375), butadiene compounds (e.g., those described in U.S. Pat. No. 4,045,229), and benzooxydole compounds (e.g., those described in U.S. Pat. No. 3,700,455) are useful. Couplers capable of absorbing ultraviolet (e.g., α-naphthol series cyan dye-forming couplers) and polymers capable of absorbing ultraviolet may also be used. Those ultraviolet absorbers may be mordanted in a specified layer.

The photographic material prepared in accordance with the present invention may contain, in the hydrophilic colloid layer, water-soluble dyes as filter dyes or to prevent irradiation, and for other purposes. Such dyes include oxonol dyes, hemioxonol dyes, styryl dyes, merocyanine dyes, cyanine dyes, and azo dyes. Among others, oxonol dyes, hemioxonol dyes, and merocyanine dyes are useful.

As a binder or a protective colloid that can be used in the emulsion layers of the present photographic material, gelatin is advantageously used, but other hydrophilic colloids can be used alone or in combination with gelatin.

In the present invention, gelatin may be lime-treated gelatin or acid-processed gelatin. Details of the manufacture of gelatin is described by Arthur Veis in *The Macromolecular Chemistry of Gelatin* (published by Academic Press, 1964).

As a base to be used in the present invention, a transparent film, such as cellulose nitrate film, and polyethylene terephthalate film or a reflection-type base that is generally used in photographic materials can be used. For the objects of the present invention, the use of a reflection-type base is more preferable.

The "reflection base" to be used in the present invention is one that enhances reflectivity, thereby making sharper the dye image formed in the silver halide emulsion layer, and it includes one having a base coated with a hydrophobic resin containing a dispersed light-reflective substance, such as titanium oxide, zinc oxide, calcium carbonate, and calcium sulfate, and also a base made of a hydrophobic resin containing a dispersed light-reflective substance. For example, there can be mentioned baryta paper, polyethylene-coated paper, polypropylene-type synthetic paper, a transparent base having a reflective layer, or additionally using a reflective substance, such as glass plate, polyester films of polyethylene terephthalate, cellulose triacetate, or cellulose nitrate, polyamide film, polycarbonate film, polystyrene film, and vinyl chloride resin, which may be suitably selected in accordance with the purpose of the application.

It is advantageous that, as the light-reflective substance, a white pigment is kneaded well in the presence of a surface-active agent, and it is preferable that the surface of the pigment particles has been treated with a divalent to tetravalent alcohol.

The occupied area ratio (%) per unit area prescribed for the white pigments finely divided particles can be obtained most typically by dividing the observed area into contiguous unit areas of 6 $\mu m \times 6$ $\mu m$, and measuring the occupied area ratio (%) (Ri) of the finely divided particles projected onto the unit areas. The deviation coefficient of the occupied area ratio (%) can be obtained based on the ratio $s/\overline{R}$, wherein s stands for the standard deviation of Ri, and $\overline{R}$ stands for the average value of Ri. Preferably, the number (n) of the unit areas to be subjected is 6 or over. Therefore, the deviation coefficient $s/\overline{R}$ can be obtained by $$\sqrt{\frac{\sum_{i=1}^{n} (\overline{R_i} - R)^2}{n-1}} \Big/ \frac{\sum_{i=1}^{n} R_i}{n}$$

In the present invention, preferably the deviation coefficient of the occupied area ratio (%) of the finely divided particles of a pigment is 0.15 or below, and particularly 0.12 or below. If the variation coefficient is 0.08 or below, it can be considered that the substantial dispersibility of the particles is substantially "uniform."

It is preferable that the color photographic material of the present invention is subjected to a color development, a bleach-fixing and an water-washing process. Bleaching and fixing process may be carried out separately other than the one-bath processing as the above.

Details of color developers used in the present invention will now be described.

The color-developer for use in the present invention may contain a known aromatic primary amine color-developing agent. Preferred examples are p-phenylenediamine derivatives. Representative examples are given below, but they are not meant to limit the present invention:

D-1: N,N-Diethyl-p-phenylenediamine
D-2: 4-[N-Ethyl-N-($\beta$-hydroxyethyl)amino]aniline
D-3: 2-Methyl-4-[N-ethyl-N-($\beta$-hydroxyethyl) amino]-aniline
D-4: 4-Amino-3-methyl-N-ethyl-N-($\beta$-methanesulfonamido ethyl)aniline These p-phenylenediamine derivatives may be in the form of salts, such as sulfates, hydrochloride, sulfites, and p-toluenesulfonates.

The amount of developing agent to be used is preferably about 0.1 g to about 20 g, more preferably about 0.5 g to about 10 g, per liter of developer.

In the present invention, it is required that the color developer contains chloride ions in an amount of $3.5\times10^{-2}$ to $1.5\times10^{-1}$ mol/l. Preferably chloride ions are contained in an amount of $4.0\times10^{-2}$ to $1.0\times10^{-1}$ mol/l. If the concentration of ions exceeds $1.5\times10^{-1}$ mol/l, development is made disadvantageously slow, not leading to attainment of the objects of the present invention, such as rapid processing and high Dmax. On the other hand, if the concentration of chloride ions is less than $3.5\times10^{-2}$ mol/l, streaked pressure-sensitized fogging is not prevented, and further, the fluctuation of photographic characteristics (in particular Dmax and Dmin) involved in continuous processing becomes great, and the residual silver after processing is large in amount, not leading to attainment of the objects of the present invention.

In the present invention, it is required that at the same time the color developer also contains bromide ions in an amount of $3.0\times10^{-5}$ to $1.0\times^{-3}$ mol/l. Preferably bromide ions are contained in an amount $5.0\times10^{-5}$ to $8.0\times10^{-4}$ mol/l, more preferably $1.0\times10^{-4}$ to $5.0\times10^{-4}$ mol/l. If the concentration of bromide ions is more than $1.0\times10^{-3}$ mol/l, the development is made slow, Dmax and the sensitivity are made low, and if the concentration of bromide ions is less than $3.0\times10^{-5}$ mol/l, the streaked pressure-sensitized fogging is not prevented, and the fluctuation of photographic characteristics (in particular, Dmax and Dmin) and insufficient desilvering are not prevented, not leading to the attainment of the objects of the present invention.

Herein, chloride ions and bromide ions may be added directly to the developer, or they may be allowed to dissolve out from the photographic material in the developer.

If chloride ions are added directly to the color developer, as the chloride ion-supplying material can be mentioned sodium chloride, potassium chloride, ammonium chloride, lithium chloride, nickel chloride, magnesium chloride, manganese chloride, calcium chloride, and cadmium chloride, with sodium chloride and potassium chloride preferred.

Chloride ions and bromide ions may be supplied from a brightening agent that will be added to the developer. As the bromide ion-supplying material can be mentioned sodium bromide, potassium bromide, ammonium bromide, lithium bromide, calcium bromide, magnesium bromide, manganese bromide, nickel bromide, cadmium bromide, cerium bromide, and thallium bromide, with potassium bromide and sodium bromide preferred.

When chloride ions and bromide ions are allowed to dissolve out from the photographic material in the developer, both the chloride ions and bromide ions may be supplied from the emulsion or a source other than the emulsion.

Preferably the color developer used in the present invention has a pH of 9 to 12, and more preferably 9 to 11.0, and it can contain other known developer components.

In order to keep the above pH, it is preferable to use various buffers. As buffers, there are included sodium carbonate, potassium carbonate, sodium bicarbonate, potassium bicarbonate, trisodium phosphate, tripotassium phosphate, disodium phosphate, dipotassium phosphate, sodium borate, potassium borate, sodium tetraborate (borax), potassium tetraborate, sodium o-hydroxybenzoate (sodium salicylate), potassium o-hydroxybenzoate, sodium 5-sulfo-2-hydroxybenzoate (sodium 5-sulfosalicylate), and potassium 5-sulfo-2-hydroxybenzoate (potassium 5-sulfosalicylate).

The amount of buffer to be added to the color developer is preferably 0.1 mol/l or more, and particularly preferably 0.1 to 0.4 mol/l.

In addition to the color developer can be added various chelating agents to prevent calcium or magnesium from precipitating or to improve the stability of the color developer. Specific examples are shown below, but the present invention is not limited to them: nitrilotriacetic acid, diethylenediaminepentaacetic acid, ethylenediaminetetraacetic acid, N,N,N-trimethylenephosphonic acid, ethylenediamine-N,N,N',N'-tetramethylenesulfonic acid, transcyclohexanediaminetetraacetic acid, 1,2-diaminopropanetetraacetic acid, glycol ether diaminetetraacetic acid, glycol ether diaminetetraacetic acid, ethylenediamine-ortho-hydroxyphenyltetraacetic acid, 2-phosphonobutane-1,2,4-tricarboxylic acid, 1-hydroxyethylidene-1,1-diphosphonic acid, N,N'-bis(2-hydroxybenzyl)ethylenediamine-N,N'-diacetic acid, catechol-3,4,6-trisulfonic acid, catechol-3,5-disulfonic acid, 5-sulfosalicylic acid, and 4-sulfosalicylic acid.

If necessary, two or more of these chelating agents may be used together.

With respect to the amount of these chelating agents to be added to the color developer, it is good if the amount is enough to sequester metal ions in the color developer. The amount, for example, is on the order of 0.1 g to 10 g per liter.

If necessary, any development accelerator can be added to the color developer. As development accelerators, the following can be added as desired: thioether compounds disclosed, for example, in JP-B Nos. 16088/1962, 5987/1962, 7826/1962, 12380/1969, and 9019/1970, and U.S. Pat. No. 3,813,247; p-phenylenediamine compounds disclosed in JP-A Nos. 49829/1977 and 15554/1975; quaternary ammonium salts disclosed, for example, in JP-A No. 137726/1975, JP-B No. 30074/1969, and JP-A Nos. 156826/1981 and 43429/1977; amine compounds disclosed, for example, in U.S. Pat. Nos. 2,494,903, 3,128,182, 4,230,796, and 3,253,919, JP-B No. 11431/1966, and U.S. Pat. Nos. 2,482,546, 2,596,926, and 3,582,346; polyalkylene oxides disclosed, for example, in JP-B Nos. 16088/1962 and 25201/1967, and U.S. Pat. No. 3,128,183, JP-B Nos. 11431/1966 and 23883/1967, and U.S. Pat. No. 3,532,501; 1-phenyl-3-pyrazolidones, and imidazoles.

It is preferable that the color developer of the present invention is substantially free from benzyl alcohol. Herein the term "substantially free from" means that the amount of benzyl alcohol is 2.0 ml or below per liter of the developer, or preferably benzyl alcohol is not contained in the developer at all, because of being the fluctuation of photographic characteristics little.

In the present invention, if necessary, any antifoggant can be added in addition to chloride ion and bromide ion. As antifoggants, use can be made of alkali metal halides, such as potassium iodide, and organic antifoggants. As typical organic antifoggants can be mentioned, for example, nitrogen-containing heterocyclic compounds, such as benzotriazole, 6-nitrobenzimidazole, 5-nitroisoindazole, 5-methylbenzotriazole, 5-nitrobenzotriazole, 5-chloro-benzotriazole, 2-thiazolylbenzimidazole, 2-thiazolylmethyl-benzimidazole, indazole, hydroxyazaindolizine, and adenine.

In the present invention, it is preferable to use the color-developer not containing sulfite ion substantially in view point of process-stability during the continuous processing and the prevention of pressure-sensitized streaks, but in order to restrain the deterioration of the developer, physical means, for example, to not use the developer for long time, and to use a floating cover or to decrease the opened surface-ratio in the developing bath to repress the effect of oxydation by air, and chemical means, for example, to control the temperature of developer, and to add an organic preservative, may be employed. Of these means the method of using an organic preservative is advantageous in view of convenience.

In the present invention, the term "organic preservative" means organic compounds generally that can reduce the rate of deterioration of aromatic primary amine color-developing agents when added to the processing solution for the color photographic material. That is, organic preservatives are organic compounds having a function to prevent color photographic agents from being oxidized with air or the like. Of these, hydroxylamine derivatives (excluding hydroxylamine, the same being applied hereinafter), hydroxamic acids, hydrazines, hydrazides, phenols, α-hydroxyketones, α-aminoketones, saccharides, monoamines, diamines, polyamines, quaternary ammonium salts, nitroxy radicals, alcohols, oximes, diamide compounds, and condensed ring-type amines are particularly effective. They are disclosed, for example, in JP-A Nos. 4235/1988, 30845/1988, 21647/1988, 44655/1988, 53551/1988, 43140/1988, 56654/1988, 581346/1988, and 43138/1988, European Patent Publication No. 254280, JP-A Nos. 44657/1988 and 44656/1988, U.S. Pat. Nos. 3,615,503 and 2,494,903, JP-A No. 143020/1987, and JP-B No. 30496/1973.

Regarding the preferable organic preservatives mentioned above, their formulas and typical compounds are mentioned below, but the present invention is not limited to them.

It is desirable that the amount of the compounds mentioned below to be added to the color developer is 0.005 to 0.5 mol/l, and preferably 0.03 to 0.1 mol/l.

As hydroxylamine derivatives, compounds represented by the following formula (II) are preferable:

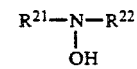

Formula (II)

wherein $R^{21}$ and $R^{22}$ each represent a hydrogen atom, a substituted or unsubstituted alkyl group, a substituted or unsubstituted alkenyl group, a substituted or unsubstituted aryl group, or a heteroaromatic group, they do not represent hydrogen atoms at the same time, and they may bond together to form a heterocyclic ring with the nitrogen atom. The ring structure of the heterocyclic ring is a 5- to 6-membered ring, it is made up of carbon atoms, halogen atoms, oxygen atoms, nitrogen atoms, sulfur atoms, etc., and it may be saturated or unsaturated.

It is preferable that $R^{21}$ and $R^{22}$ each represent an alkyl group or an alkenyl group having preferably 1 to 10 carbon atoms, more preferably 1 to 5 carbon atoms. As nitrogen-containing heterocyclic rings formed by bonding $R^{21}$ and $R^{22}$ together can be mentioned, for example, a piperidyl group, a pyrolidyl group, an N-alkylpiperazyl group, a morpholyl group, an indolinyl group, and a benztriazole group.

Preferable substituents of $R^{21}$ and $R^{22}$ are a hydroxyl group, an alkoxy group, an alkylsulfonyl group, an arylsulfonyl group, an amido group, a carboxyl group, a cyano group, a sulfo group, a nitro group, and an amino group.

Exemplified compounds:

$C_2H_5-N(OH)-C_2H_5$ II - 1

$CH_3OC_2H_4-N(OH)-C_2H_4-OCH_3$ II - 2

$C_2H_5OC_2H_4-N(OH)-CH_2-CH=CH_2$ II - 3

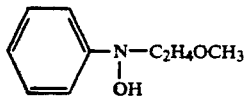
II - 4

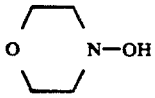
II - 5

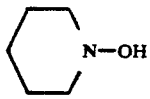
II - 6

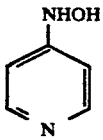
II - 7

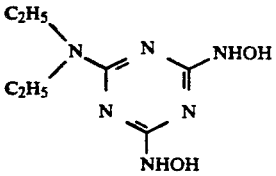
II - 8

As hydrazines and hydrazides the following compounds are preferable:

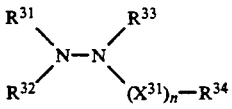
Formula (III)

wherein $R^{31}$, $R^{32}$, and $R^{33}$ each independently represent a hydrogen atom, a substituted or unsubstituted alkyl group, a substituted or unsubstituted aryl group, or a substituted or unsubstituted heterocyclic group; $R^{34}$ represents a hydroxy group, a hydroxyamino group, a substituted or unsubstituted alkyl group, a substituted or unsubstituted heterocyclic group, a substituted or unsubstituted alkoxy group, a substituted or unsubstituted aryloxy group, a substituted or unsubstituted carbamoyl group, or a substituted or unsubstituted amino group. The heterocyclic group is a 5- or 6-membered ring made up of C, H, O, N, S, and/or a halogen atom, and it may be substituted or unsubstituted. $X^{31}$ represents a divalent group selected from —CO—, $—SO_2—$, and

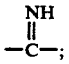

n is 0 or 1, provided that when n=0, $R^{34}$ represents a group selected from an alkyl group, an aryl group, or a heterocyclic group. $R^{33}$ and $R^{34}$ may together form a heterocyclic ring.

In formula (III), $R^{31}$, $R^{32}$, and $R^{33}$ each are preferably a hydrogen atom or an alkyl group having 1 to 10 carbon atoms, particularly $R^{31}$ and $R^{32}$ each are most preferably a hydrogen atom.

In formula (III), $R^{34}$ is preferably an alkyl group having 1 to 20 carbon atoms, an aryl group having 6 to 20 carbon atoms, an alkoxy group having 1 to 20 carbon atoms, a carbamoyl group having 1 to 20 carbon atoms, or an amino group having 0 to 20 carbon atoms, in particular preferably an alkyl group or a substituted alkyl group. The preferable substituents of an alkyl group include a carboxyl group, a sulfo group, a nitro group, an amino group, and a phosphono group. $X^{31}$ is preferably —CO— or $—SO_2—$, most preferably —CO—.

Exemplified compounds:

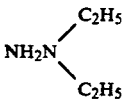
III - 1

$NH_2NH(CH_2)_4SO_3H$ III - 2

$NH_2NH(CH_2)_2OH$ III - 3

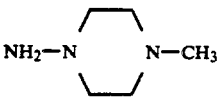
III - 4

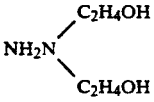
III - 5

$NH_2NHCOCH_3$ III - 6

$NH_2NHCOOC_2H_5$ III - 7

-continued

III - 8

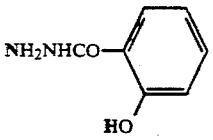

III - 9

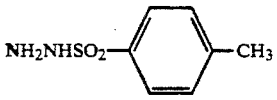

$NH_2NHCONH_2$ III - 10

III - 11

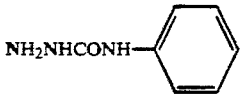

$NH_2NHSO_3H$ III - 12

III - 13

$NH_2NH\overset{\overset{\displaystyle NH}{\|}}{C}NH_2$ $NH_2NHCOCONHNH_2$ III - 14

$NH_2NHCH_2CH_2CH_2SO_3H$ III - 15

III - 16

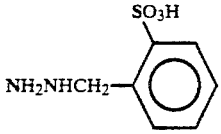

$NH_2NHCH\underset{\underset{\displaystyle C_4H_9(n)}{|}}{C}OOH$ III - 17

$NH_2NHCH_2CH_2COOH$ III - 18

III - 19

$NH_2N(CH_2COOH)_2$

III - 20

$NH_2N(CH_2CH_2CH_2SO_3H)_2$

III - 21

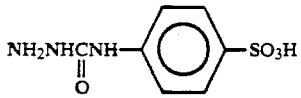

III - 22

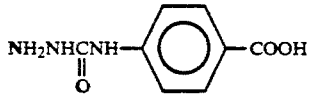

It is preferable to use the compound represented by formula (II) or (III) in combination with the compound represented by the following formula (IV) or (V), in view of hither stability of the color developer, that is, higher stability during continuous processing.

Formula (IV)

$$R^{71}-\overset{\overset{\displaystyle R^{72}}{|}}{N}-R^{73}$$

wherein $R^{71}$, $R^{72}$, and $R^{73}$ each represent a hydrogen atom, an alkyl group, an alkenyl group, an aryl group, an aralkyl group or a heterocyclic group, and $R^{71}$ and $R^{72}$, $R^{71}$ and $R^{73}$, or $R^{72}$ and $R^{73}$ may bond together to form a nitgrogen-containing heterocyclic group.

$R^{71}$, $R^{72}$, and $R^{73}$ may have a substituent. Particularly preferably $R^{71}$, $R^{72}$, and $R^{73}$ each represent a hydrogen atom or an alkyl group. As a substituent can be mentioned, for example, a hydroxyl group, a sulfo group, a carboxyl group, a halogen atom, a nitro group, and an amino group.

Exemplified compounds:

$N(CH_2CH_2OH)_3$ IV-1

$H_2NCH_2CH_2OH$ IV-2

$HN(CH_2CH_2OH)_2$ IV-3

IV-4

$C_7H_{15}N(CH_2\overset{\overset{\displaystyle OH}{|}}{C}HCH_2OH)_2$

IV-5

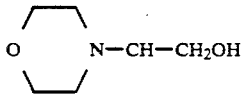

IV-6

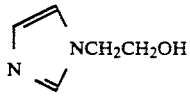

IV-7

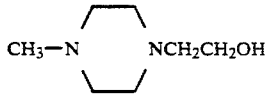

IV-8

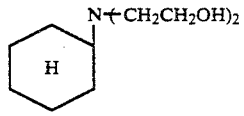

IV-9

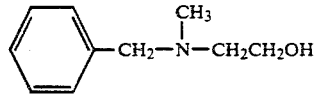

$(HOCH_2CH_2)_2NCH_2CH_2SO_2CH_3$ IV-10

$HN(CH_2COOH)_2$ IV-11

IV-12

$HOOCCH_2CH_2\underset{\underset{\displaystyle NH_2}{|}}{C}HCOOH$ $H_2NCH_2CH_2SO_2NH_2$ IV-13

IV-14

$(C_2H_5)_2N-CH_2CH_2OCH_2CH_2OH$ $H_2N-C(CH_2OH)_2$ IV-15

IV-16

$HOCH_2\underset{\underset{\displaystyle NH_2}{|}}{C}HCOOH$

IV-17

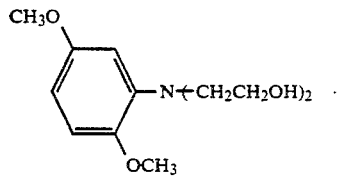

-continued

IV-18

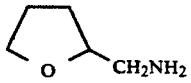

IV-19

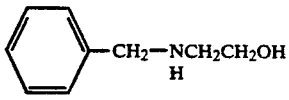

IV-20

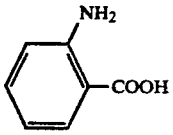

Formula (V)

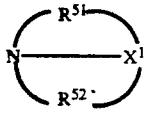

wherein $X^1$ represents a trivalent group of atoms necessary to complete a condensed ring, and $R^{51}$ and $R^{52}$ each represent an alkylene group, an arylene group, an alkenylene group, or an aralkylene group.

$R^{51}$ and $R^{52}$ may be the same or different.

Of the compounds represented by formula (V), particularly preferable compounds are those represented by formulae (V-a) and (V-b):

Formula (V-a)

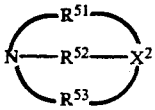

wherein $X^2$ represents

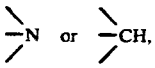

$R^{51}$ and $R^{52}$ have the same meaning as defined above for formula (V), and $R^{53}$ has the same meaning as $R^{51}$ or $R^{52}$ or represents

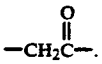

In formula (V-a), preferably $X^2$ represents

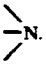

Preferably the number of carbon atoms of $R^{51}$, $R^{52}$, and $R^{53}$ is 6 or below, more preferably 3 or below, and most preferably 2.

Preferably $R^{51}$, $R^{52}$, and $R^{53}$ each represent an alkylene group or an arylene group, most preferably an alkylene group.

Formula (V-b)

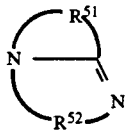

wherein $R^{51}$ and $R^{52}$ have the same meaning as defined in formula (V).

In formula (V-b), preferably the number of carbon atoms of $R^{51}$ and $R^{52}$ is 6 or below. Preferably $R^{51}$ and $R^{52}$ each represent an alkylene group or an arylene group, most preferably an alkylene group.

Of compounds represented by formulae (V-a) and (V-b), those represented by formula (V-a) are preferable.

V-1

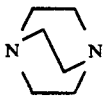

V-2

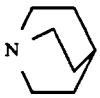

V-3

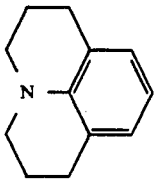

V-4

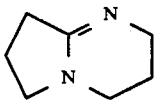

V-5

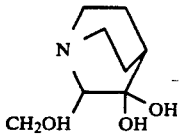

V-6

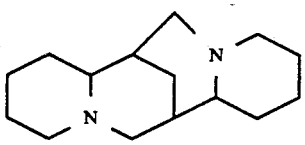

V-7

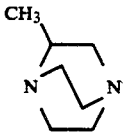

V-8

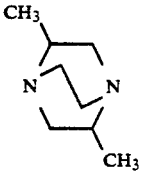

-continued

V-9

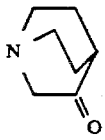

V-10

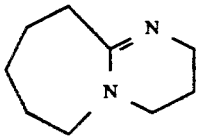

V-11

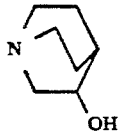

V-12

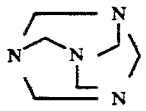

V-13

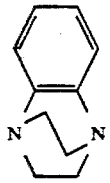

V-14

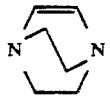

V-15

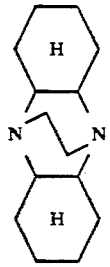

V-16

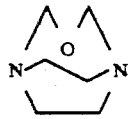

V-17

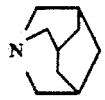

V-18

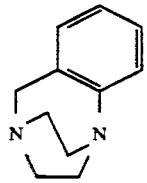

The above-mentioned organic preservatives can be commercially available, but they can also be synthesized by method described, for example, in JP-A Nos. 170642/1988 and 239447/1988.

It is preferable that the color developer used in the present invention contains a brightening agent. As a brightening agent, 4,4'-diamino-2,2'-disulfostilbene compounds are preferable. The amount of brightening agent to be added is 0 to 10 g/l, preferably 0.1 to 6 g/l.

If necessary, various surface-active agents, such as alkyl sulfonates, aryl sulfonates, aliphatic acids, and aromatic carboxylic acids, dye-forming couplers, competitive couplers, fogging agents, such as sodium boronhydride, auxiliary developing agents, such as 1-phenyl-3-pyrazolydone, and tackifiers may be added.

The processing temperature of the color developer of the invention is 20° to 50° C., preferably 30° to 40° C. The processing time is 20 sec to 5 min, preferably 30 sec to 2 min.

In color developing the developer is usually replenished. The replenishing amount is generally in the range of about 180 to 1000 ml per square meter of the photographic material, although it depends on the photographic material to be processed. Replenishing is a mean to keep the constituent of the color developer constant to avoid a change of finishing characteristics due to a change of the constituent concentration in a development processing, such as a continuous processing for a large amount of photographic material, for example, using an automatic processor, but it is preferable that the amount is as small as possible, in view of economy and pollution, because of the large amount of solution overflowed by replenishing. The preferable replenishing amount is 20 to 150 ml per square meter of the photographic material. A replenishing amount of 20 ml per square meter of the photographic material means that the carried-over amount of developer by the photographic material is almost equal to the replenishing amount, although the amount differs a little depending on the photographic material. The effect of the present invention can be attained at processing carried out with such a low replenishing amount.

In the present invention, a desilvering process is carried out following a color-developing process. The desilvering process consists usually of a bleaching process and a fixing process, but it is particularly preferable to carried out the two process at the same time.

Further, the bleaching solution or the bleach-fixing solution used in the present invention can contain rehalogenation agents, such as bromides (e.g., potassium bromide, sodium bromide, and ammonium bromide), chlorides (e.g., potassium chloride, sodium chloride, and ammonium chloride), or iodides (e.g., ammonium iodide). If necessary the bleaching solution or the bleach-fixing solution can contain, for example, one or more inorganic acids and organic acids or their alkali salts or ammonium salts having a pH-buffering function, such as borax, sodium metaborate, acetic acid, sodium acetate, sodium carbonate, potassium carbonate, phosphorous acid, phosphoric acid, sodium phosphate, citric acid, sodium citrate, and tartaric acid, and ammonium nitrate, and guanidine as a corrosion inhibitor.

The fixing agent used in the bleach-fixing solution or the bleaching solution according to the present invention can use one or more of water-soluble silver halide solvents, for example thiosulfates, such as sodium thiosulfate and ammonium thiosulfate, thiocyanates, such as sodium thiocyanate and ammonium thiocyanate, thiourea compounds and thioether compounds, such as ethylenebisthioglycolic acid and 3,6-dithia-1,8-octanediol. For example, a special bleach-fixing solution comprising a combination of a fixing agent described in JP-A No. 155354/1980 and a large amount of a halide, such as potassium iodide, can be used. In the present invention, it is preferable to use thiosulfates, and particularly ammonium thiosulfate. The amount of the fixing agent per liter is preferably 0.3 to 2 mol, and more preferably 0.5 to 1.0 mol.

The pH range of the bleach-fixing solution or the fixing solution is preferably 3 to 10, and particularly preferably 5 to 9. If the pH is lower than this range, the desilvering is improved, but the deterioration of the solution and the leucolization of cyan dye are accelerated. In reverse, if the pH is higher than this range, the desilvering is retarded and stain is liable to occur.

To adjust pH, if necessary, a compound such as hydrochloric acid, sulfuric acid, nitric acid, acetic acid, bicarbonate, ammonia, caustic potassium, caustic soda, sodium carbonate and potassium carbonate may be added.

Further, the bleach-fixing solution may additionally contain various brightening agents, anti-foaming agents, surface-active agents, polyvinyl pyrrolidone, and organic solvents, such as methanol.

The bleach-fixing solution or the fixing solution used in the present invention contains, as a preservative, sulfites (e.g., sodium sulfite, potassium sulfite, and ammonium sulfite), bisulfites (e.g., ammonium bisulfite, sodium bisulfite, and potassium bisulfite), and methabisulfites (e.g., potassium metabisulfite, sodium metabisulfite, and ammonium metabisulfite). Preferably these compounds are contained in an amount of 0.02 to 0.50 mol/l, and more preferably 0.04 to 0.40 mol/l, in terms of sulfite ions.

As a preservative, generally a bisulfite is added, but other compounds, such as ascorbic acid, carbonyl bisulfite addition compound, or carbonyl compounds, may be added.

If required, for example, buffers, brightening agents, chelate agents, anti-foaming agents, and mildew-proofing agents may be added.

The silver halide color photographic material used in the present invention is generally washed and/or stabilized after the fixing or the desilvering, such as the bleach-fixing.

The amount of washing water in the washing step can be set over a wide range, depending on the characteristics of the photographic material (e.g., the characteristics of the materials used, such as couplers), the application of the photographic material, the washing water temperature, the number of the washing water tanks (stages), the type of replenishing (i.e., depending on whether the replenishing is of the countercurrent type or of the down flow type), and other various conditions. The relationship between the number of washing water tanks and the amount of water in the multi-stage countercurrent system can be determined based on the method described in *Journal of the Society of Motion Picture and Television* Engineers, Vol. 64, pp. 248 to 253 (May 1955).

According to the multi-stage countercurrent system, the amount of washing water can be reduced considerably. But a problem arises that bacteria can propagate due to the increase in the residence time of the water in the tanks, and the suspended matter produced will adhere to the photographic material. To solve such a problem in processing the color photographic material of the present invention, the process for reducing calcium and magnesium described in JP-A No. 288838/1987 can be used quite effectively. Further, isothiazolone compounds and thiabendazoles described in JP-A No. 8542/1982, chlorine-type bactericides, such as sodium chlorinated isocyanurates described in JP-A No. 120145/1986, benzotriazoles described in JP-A No. 267761/1986, copper ions, and bactericides described by Hiroshi Horiguchi in *Bokin Bobai-zai no Kagaku, Biseibutsu no Genkin, Sakkin, Bobai Gijutsu* (edited by Eiseigijutsu-kai), and *Bokin Bobai-zai Jiten* (edited by Nihon Bokin Bobai-gakkai), can be used.

The pH range of the washing water in the processing steps for the photographic material of the present invention may be 4 to 9, preferably 5 to 8. The temperature and time of washing, which can be set according to the use or property of the photographic material, is generally in the range 15 °to 45° C. and 20 sec. to 10 min, preferably 25° to 40° C. and 30 sec to 5 min.

Further, the photographic materials of the present invention can be processed directly by a stabilizing solution without a washing step. In such a stabilizing process, all known methods described, for example, in JP-A Nos. 8543/1982, 14834/1983, 184343/1984, 220345/1985, 238832/1985, 239784/1985, 239749/1985, 4045/1986, and 118749/1986 can be used. A preferred inclusion is to use a stabilizing bath containing 1-hydroxyethylidene-1,1-diphosphonate, 5-chloro-2-methyl-4-isothiazolone-3-one, a bismuth compound, or an ammonium compound.

In some cases a stabilizing process is carried out following the above-described washing process, and an example of such cases is a stabilizing bath containing formalin and a surface-active agent for use as a final bath for color photographic materials for photographing.

The time of processing process of the present invention is defined as the period from when the photographic material contacts the color developer to when it comes out of the last bath (generally a washing bath or stabilizing bath), and the effect of the present invention can be remarkably exhibited with a rapid processing time of 4 min 30 sec or below, preferably 4 min or below.

Now the present invention will be described in detail with reference to examples, but the invention is not limited to them.

EXAMPLE 1

A multilayer color photographic paper was prepared by coating layers as hereinbelow described on a paper laminated on both sides with polyethylene. Coating solutions were prepared as follows:

Preparation of the First Layer Coating Solution

To a mixture of 60.0 g of yellow coupler (ExY) and 28.0 g of discoloration inhibitor (Cpd-1), 150 ml of ethyl acetate, 1.0 ml of solvent (Solv-3) and 3.0 ml of solvent (Solv-4) were added and dissolved. The resulting solution was added to 450 ml of 10% aqueous gelatin solution containing sodium dodecylbenzenesulfonate, and then the mixture was dispersed by a supersonic homogenizer. The resulting dispersion was mixed with and dissolved in 420 g of silver chlorobromide emulsion (silver bromide: 0.7 mol %) containing a blue-sensitive sensitizing dye, described below, to prepare the first layer coating solution. Coating solutions for the second to seventh layers were also prepared in the same manner as in the first layer coating solution. As a gelatin hardener for the respective layers, 1,2-bis(vinylsulfonyl) ethane was used.

As spectral sensitizers for the respective layers, the following compounds were used:

Blue-sensitive emulsion layer:
Anhydro-5,5'-dichloro-3,3'-disulfoethylthiacyanine hydroxide
Green-sensitive emulsion layer:
Anhydro-9-ethyl-5,5'-diphenyl-3,3'-disulfoethyloxacarbocyanine hydroxide
Red-sensitive emulsion layer:
3,3'-Diethyl-5-methoxy-9,9'-(2,2'-dimethyl-1,3-propano)thiacarbocyanine iodide As stabilizers for the respective layers, a mixture (7:2:1 in molar ratio) of the following compounds was used:

1-(2-Acetoaminophenyl)-5-mercaptotetrazole,
1-Phenyl-5-mercaptotetrazole, and
1-(p-Methoxyphenyl)-5-mercaptotetrazole As irradiation preventing dyes the following compounds were used.

[3-Carboxy-5-hydroxy-4-(3-(3-carboxy-5-oxo-1-(2,5-disulfonatophenyl)-2-pyrazoline-4-iridene)-1-propenyl)-1-pyrazolyl]benzene-2,5-disulfonatodisodium salt,
N,N'-(4,8-Dihydroxy-9,10-dioxo-3,7-disolfonatoanthracene- 1,5-diyl)bis(aminomethanesulfonato)-tetrasodium salt, and
[3-Cyano-5-hydroxy-4-(3-(3-cyano-5-oxo-1-(4-sulfonatophenyl)-2-pyrazoline-4-iridene)-1-pentanyl)-1-pyrazolyl]benzene-4-sulfonato-sodium salt

COMPOSITION OF LAYERS

The composition of each layer is shown below. The figures represent coating amounts (g/m$^2$). The coating amounts of each silver halide emulsion is represented in terms of silver.

Base

Paper laminated on both sides with polyethylene.

First Layer (Blue-sensitive emulsion layer)
The above-described silver chlorobromide emulsion

| | |
|---|---|
| (AgBr: 0.7 mol %, cubic grain, average grain size: 0.9 μm) | 0.27 |
| Gelatin | 1.80 |
| Yellow coupler (ExY) | 0.60 |
| Discoloration inhibitor (Cpd-1) | 0.28 |
| Solvent (Solv-3) | 0.01 |
| Solvent (Solv-4) | 0.03 |

Second Layer (Color-mix preventing layer)

| | |
|---|---|
| Gelatin | 0.80 |
| Color-mix inhibitor (Cpd-2) | 0.055 |
| Solvent (Solv-1) | 0.03 |
| Solvent (Solv-2) | 0.015 |

Third Layer (Green-sensitive emulsion layer)
The above-described silver chlorobromide emulsion

| | |
|---|---|
| (AgBr: 0.7 mol %, cubic grain, average grain size: 0.45 μm) | 0.28 |
| Gelatin | 1.40 |
| Magenta coupler (ExM) | 0.37 |
| Discoloration inhibitor (Cpd-3) | 0.23 |
| Discoloration inhibitor (Cpd-4) | 0.11 |
| Solvent (Solv-1) | 0.20 |
| Solvent (Solv-2) | 0.02 |

Fourth Layer (Color-mix preventing layer)

| | |
|---|---|
| Gelatin | 1.70 |
| Color-mix inhibitor | 0.065 |
| Ultraviolet ray absorber (UV-1) | 0.45 |
| Ultraviolet ray absorber (UV-2) | 0.23 |
| Solvent (Solv-1) | 0.05 |
| Solvent (Solv-2) | 0.05 |

Fifth Layer (Red-sensitive emulsion layer)
The above-described silver chlorobromide emulsion

| | |
|---|---|
| (ArBg: 2 mol %, cubic grain, average grain size: 0.5 μm) | 0.19 |
| Gelatin | 1.80 |
| Cyan coupler (ExC-1) | 0.26 |
| Cyan coupler (ExC-2) | 0.12 |
| Discoloration inhibitor (Cpd-1) | 0.20 |
| Solvent (Solv-1) | 0.16 |
| Solvent (Solv-2) | 0.09 |

Sixth Layer (Ultraviolet ray absorbing layer)

| | |
|---|---|
| Gelatin | 0.70 |
| Ultraviolet ray absorber (UV-1) | 0.26 |
| Ultraviolet ray absorber (UV-2) | 0.07 |
| Solvent (Solv-1) | 0.30 |
| Solvent (Solv-2) | 0.09 |

Seventh Layer (Protective layer)

| | |
|---|---|
| Gelatin | 1.07 |

Compounds used are as follows:

(ExY) Yellow coupler:
α-Pivalyl-α-(3-benzyl-1-hidantoinyl)-2-chloro-5[β-(dodecylsulfonyl)butyramido]acetanilide
(ExM) Magenta coupler:
1-(2,4,6-Trichlorophenyl)-3[2-chloro-5(3-octadecenylsuccinimido)anilino]-5-pyrazolone
(ExC-1) Cyan coupler:
2-Pentafluorobenzamido-4-chloro-5[2-(2,4-di-tert-amylphenoxy)-3-methylbutyramido]phenol
(ExC-2) Cyan coupler:
2,4-Dichloro-3-methyl-6-[α-(2,4-di-tert-amylphenoxy)-butyramido]phenol
(Cpd-1) Discoloration inhibitor:
2,5-Di-tert-amylphenyl-3,5-di-tert-butylhydroxybenzoate
(Cpd-2) Color-mix inhibitor:
2,5-Di-tert-octylhydroquinone
(Cpd-3) Discoloration inhibitor:
1,4-di-tert-amyl-2,5-dioctyloxybenzene
(Cpd-4) Discoloration inhibitor:
2,2'-methylenbis(4-methyl-6-tert-butylphenol)
(Cpd-5):

p-(p-Toluenesulfonamido)phenyl-dodecane
(Solv-3) Solvent:
Di(nonyl)phthalate
(Solv-4) Solvent:
N,N-diethylcarbonamido-methoxy-2,4-di-t-amylbenzene
(UV-1) Ultraviolet ray absorber:
2-(2-Hydroxy-3,5-di-tert-amylphenyl)benzotriazole
(UV-2) Ultraviolet ray absorber:
2-(2-Hydroxy-3,5-di-tert-butylphenyl)benzotriazole
(Solv-1) Solvent:
Di(2-ethylhexyl)phthalate
(Solv-2) Solvent:
Dibutylphthalate The thus-prepared sample is designated Sample 01.

Sample 02 to 05 were prepared in the same manner as Sample 01, except that the halogen compositions of the silver halide emulsions in the first, third, and fifth layers were changed as shown in Table 1.

TABLE 1

| | Halogen Composition in emulsion used (Cl mol %) | | |
|---|---|---|---|
| Sample | 1st layer (BL) | 3rd layer (GL) | 5th layer (RL) |
| 01 | 99.3 | 99.3 | 98.0 |
| 02 | 90.0 | 90.0 | 90.0 |
| 03 | 80.0 | 80.0 | 80.0 |
| 04 | 70.0 | 70.0 | 70.0 |
| 05 | 60.0 | 60.0 | 60.0 |

Next samples were prepared in the same manner as the above using the same halogen composition in Table 1, except that the yellow coupler in the third layer was changed to an equimolar of coupler Y-11 of the present invention. These samples were designated Samples 06 to 10.

Further, another silver halide color photographic sample was prepared by coating multilayers described hereinbelow successively on the base paper laminated on both sides with polyethylene.

First Layer: Blue-sensitive silver halide emulsion layer

A silver chlorobromide emulsion consisting of 96 mol % of silver chloride and being spectral-sensitized by adding $2.5\times10^{-4}$ mol of sensitizing dye described below (solvent: isopropyl alcohol) was used. The emulsion contained 350 g of gelatin per 1 mol of silver halide.

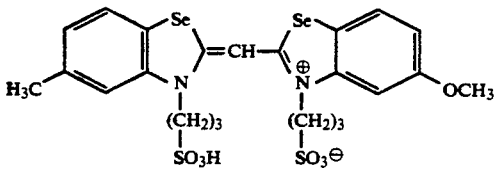

Coating was carried out so that the coating amount of the emulsion further containing 2,5-di-t-butyl-hydroquinone dissolved and dispersed in dibutylphthalate (DBP), and a yellow coupler having a structure described below in an amount of $2\times10^{-1}$ mol per mol of silver halide, became 250 mg/m$^2$ in terms of silver, and the coating amount of 2,5-di-t-butylhydroquinone became 200 mg/m$^2$.

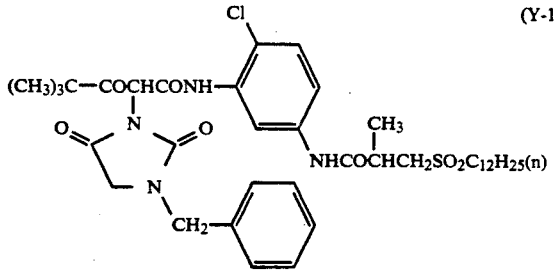

Second Layer: UV absorbing layer

Coating was carried out so that the coating amounts of di-t-octylhydroquinone dissolved in DBP, a mixture of four compounds described below as UV absorber and gelatin, became 300 mg/m$^2$, 200 mg/m$^2$, and 1900 mg/m$^2$, respectively.

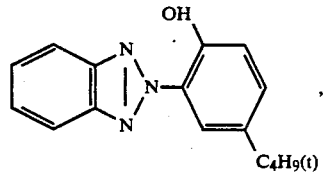

(a)

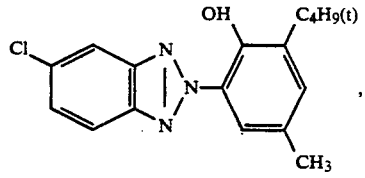

(b)

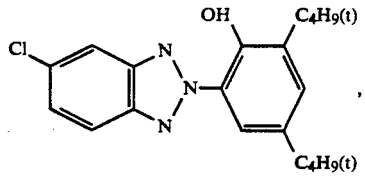

(c)

and

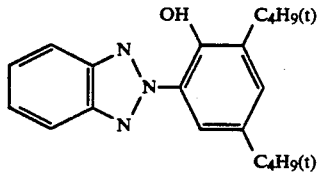

(d)

Third Layer: Green-sensitive silver halide emulsion layer

A silver chlorobromide emulsion consisting of 96 mol % of silver chloride, containing 450 g of gelatin per mol of silver halide and being spectral-sensitized by adding $2.5\times10^{-2}$ mol of sensitizing dye described below was used.

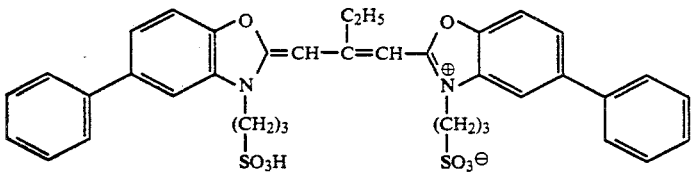

Coating was carried out so that the coating amount of the emulsion further containing $1.5\times10^{-1}$ mol per mol of silver halide of a magenta coupler, having a structure described below, which had been dissolved and dispersed in a mixed solvent of DBP and tricresyl phosphate (TCP) in a ratio of 2:1, became 250 mg/m$^2$ in terms of silver.

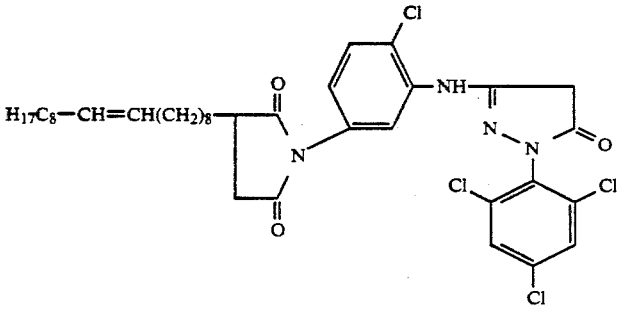

Further, the compound described below was added in an amount of 0.3 mol per mol of the coupler as an oxidation inhibitor.

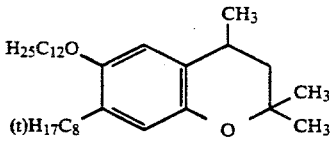

Fourth Layer: UV absorbing layer

Coating was carried out so that the coating amounts of di-t-octylhydroquinone dissolved and dispersed in dioctyl phthalate (DOP), a mixture of the above-described compounds (a), (b), (c), and (d) (in a ratio of 2:2:1.5:1.5) as ultraviolet absorber, and gelatin became 30 mg/m$^2$, 500 mg/m$^2$, and 1900 mg/m$^2$, respectively.

Fifth Layer: Red-sensitive silver halide emulsion layer

A silver chlorobromide emulsion consisting of 96 mol % of silver chloride, containing 500 g of gelatin per mol of silver halide and being spectral-sensitized by adding $2.5\times10^{-5}$ mol of sensitizing dye described below, was used.

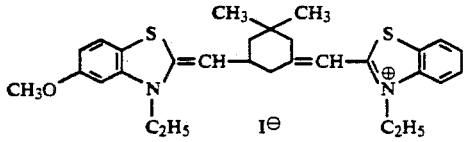

Coating was carried out so that the coating amount of the emulsion further containing 2,5-di-t-butylhydroquinone dissolved and dispersed in DBP and cyan couplers having structures described below (a mixture of 1:1 in molar ratio), in an amount of $3.5\times10^{-1}$ mol per mol of silver halide, became 220 mg/m$^2$ in terms of silver, and the coating amount of 2,5-di-t-butylhydroquinone became 150 mg/m$^2$.

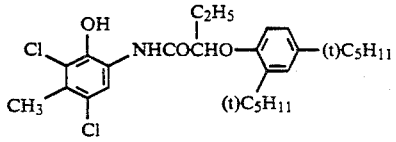

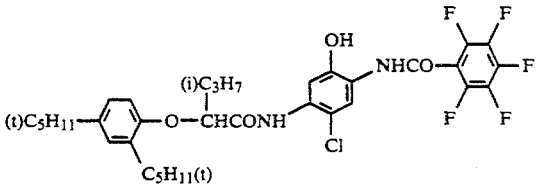

Sixth Layer: Gelatin layer

Coating was carried out so that the coating amount of gelatin became 900 mg/m$^2$.

The silver halide emulsions used in the photosensitive emulsion layer of the first, second, and fifth layers were prepared in accordance with the process described in JP-B No. 7772/1971, and they were sensitized chemically with sodium thiosulfate pentahydrate, and as a stabilizer, a hardener, coating aids, use was made of 4-hydroxy-6-methyl-1,3,3a,7-tetrazaindene, bis(vinyl sulfonylmethyl)ether, and saponin, respectively.

The thus-prepared sample was designated Sample 11.

To investigate the photographic characteristics of these Samples 01 to 11, the following tests were performed.

First, each of the Samples was subjected to a gradation exposure to three separated colors, for sensitometry using a sensitometer (FWH model made by Fuji Photo Film Co., Ltd., the color temperature of the light source was 3200° K.). At that time exposure was carried out in such a manner that it was 250 CMS with an exposure time of 0.1 sec. After processing, the density of the obtained yellow dye image was measured to obtain the maximum density (Dmax). The results are shown in Table 2.

Additionally, Samples 01 to 11 were also subjected to a gray uniform exposure using the above-described sensitometer, and to processing in the same manner as the above sensitometry, and then the pressure-sensitized streaks were evaluated. The results are also shown in Table 2. The evaluation was graded into the following four classes.

| Evaluation of Pressure-sensitized Streaks | Number of Pressure-sensitized Streaks per 100 $m^2$ (10 cm × 10 cm) of sample |
|---|---|
| ○ | Nil |
| Δ | 1 to 2 |
| X | 3 to 4 |
| XX | 5 or over |

The exposed samples were processed in the following processing steps with the following processing solutions having the given compositions using an automatic processor. In this processing, concentrations of halide ions, e.g., chloride ions and bromide ions, in the color developer were changed as shown in Table 2.

-continued

| | |
|---|---|
| N-Ethyl-N-(β-methanesulfonamidoethyl)-3-methyl-4-aminoaniline sulfate | 5.0 g |
| Triethanolamine | 10.0 g |
| Fluorescent brightening agent (4,4' diamino- stilbene series, WHITEX-4, made by Sumitomo Chemical Industries) | 2.0 g |
| Water to make | 1000 ml |
| pH (25° C.) | 10.05 |
| Bleach-fixing solution | |
| Water | 400 ml |
| Ammonium thiosulfate (70%) | 100 ml |
| Sodium sulfite | 17 g |
| Iron (III) ammonium ethylenediamine-tetraacetate | 55 g |
| Disodium ethylenediaminetetraacetate | 5 g |
| Ammonium bromide | 40 g |
| Glacial acetic acid | 9 g |
| Water to make | 1000 ml |
| pH (25° C.) | 5.40 |
| Rinsing solution | |
| Deionized water (the ion-concentrations of Ca and Mg each were 3 ppm or below) | |

TABLE 2

| Process No. | Photographic Material No. | Halide Ion Concentration in Developer (mol/l) $C^-$ | $Br^-$ | Maximum Density | Pressure-sensitized Streak | Remarks |
|---|---|---|---|---|---|---|
| 1 | 01 | $4.0 \times 10^{-2}$ | $5.0 \times 10^{-5}$ | 2.12 | ○ | Comparative Example |
| 2 | 01 | $4.0 \times 10^{-2}$ | $5.0 \times 10^{-6}$ | 2.22 | XX | " |
| 3 | 01 | $1.0 \times 10^{-1}$ | $1.0 \times 10^{-2}$ | 1.89 | ○ | " |
| 4 | 01 | $4.0 \times 10^{-2}$ | — | 2.25 | X | " |
| 5 | 01 | — | $3.0 \times 10^{-5}$ | 2.18 | XX | " |
| 6 | 02 | $4.0 \times 10^{-2}$ | $5.0 \times 10^{-5}$ | 2.06 | ○ | " |
| 7 | 03 | " | " | 2.01 | ○ | " |
| 8 | 04 | " | " | 1.96 | ○ | " |
| 9 | 05 | " | " | 1.90 | ○ | " |
| 10 | 06 | $4.0 \times 10^{-2}$ | $5.0 \times 10^{-6}$ | 2.30 | X | " |
| 11 | 06 | $1.0 \times 10^{-1}$ | $1.0 \times 10^{-2}$ | 2.23 | ○ | " |
| 12 | 06 | $4.0 \times 10^{-2}$ | — | 2.26 | X | " |
| 13 | 06 | " | $3.0 \times 10^{-5}$ | 2.22 | XX | " |
| 14 | 09 | $4.0 \times 10^{-2}$ | $5.0 \times 10^{-5}$ | 2.00 | ○ | " |
| 15 | 10 | " | " | 1.96 | ○ | " |
| 16 | 06 | " | " | 2.42 | ○ | This Invention |
| 17 | 07 | $4.0 \times 10^{-2}$ | $5.0 \times 10^{-5}$ | 2.41 | ○ | " |
| 18 | 08 | " | " | 2.40 | ○ | " |
| 19 | 06 | $1.0 \times 10^{-1}$ | $5.0 \times 10^{-4}$ | 2.40 | ○ | " |
| 20 | 07 | " | " | 2.39 | ○ | " |
| 21 | 08 | " | " | 2.41 | ○ | " |
| 22 | 06 | $4.0 \times 10^{-2}$ | $5.0 \times 10^{-5}$ | 2.43 | ○ | " |
| 23 | 07 | " | " | 2.40 | ○ | " |
| 24 | 08 | " | " | 2.41 | ○ | " |
| 25 | 11 | " | " | 2.42 | ○ | " |
| 26 | 06 | $5.4 \times 10^{-2}$ | $1.7 \times 10^{-3}$ | 2.40 | Δ | Comparative Example |

| Processing steps | | |
|---|---|---|
| Step | Temperature | Time |
| Color Development | 38° C. | 45 sec. |
| Bleach-fixing | 30–36° C. | 45 sec. |
| Rinsing ① | 30–37° C. | 30 sec. |
| Rinsing ② | 30–37° C. | 30 sec. |
| Rinsing ③ | 30–37° C. | 30 sec. |
| Drying | 70–80° C. | 60 sec. |

The composition of the respective processing solution were as follows:

| Color developer | |
|---|---|
| Water | 800 ml |
| Ethylenediamine-N,N,N,N-tetramethylene phosphonic acid | 3.0 g |
| N,N-diethylhydroxylamine | 4.2 g |
| Sodium chloride | see Table 2 |
| Potassium bromide | see Table 2 |
| Potassium carbonate | 25 g |

In processes 1 to 7, a photographic material having a high-silver-chloride emulsion and containing a yellow coupler that did not fall within the scope of the present invention was processed with color developers having varied halide ion concentrations. However, in the processes a photographic material excellent with respect to pressure-sensitized streaks resulted in lower maximum density, which result means both of pressure-sensitized streaks and maximum density could not be solved at the same time. In processes 8 and 9, the silver halide emulsion was low in silver chloride content, and the reduction of the maximum density was remarkable. In processes 10 to 13, and 16 to 25, a photosensitive material having a high-silver-chloride emulsion and containing a yellow coupler of the present invention was processed with the halide ion concentration varied, and it can be understood that only a material that was processed with a color developer whose halide ion concentrations fell in the range of the present invention was free from pressure-sensitized streaks and excellent in maximum density. In processes 14 and 15, in which the silver halide emulsion was low in silver chloride content, although the halide ion concentrations of the color developer were in the range of the present invention, the maximum density was low.

In the processes 16 to 25 of the present invention in which the halide ion concentrations were in the ranges of the present invention, the maximum density was improved, which result is an unexpected effect.

EXAMPLE 2

A multilayer color photographic paper having layer-compositions described below was prepared by coating on a paper laminated on both sides with polyethylene. Coating solutions were prepared as follows:

Preparation of the First Layer Coating Solution

To a mixture of 19.1 g of yellow coupler (ExY), 4.4 g of image-dye stabilizer (Cpd-1) and 0.7 g of image-dye stabilizer (Cpd-7), 27.2 ml of ethyl acetate and 8.2 g of solvent (Solv-3) were added and dissolved. The resulting solution was dispersed and emulsified in 185 ml of 10% aqueous gelatin solution containing 8 ml of sodium dodecylbenzenesulfonate. Separately another emulsion was prepared by adding two kinds of blue-sensitive sensitizing dye, shown below, to a silver chlorobromide emulsion (cubic grains having 0.85 μm of grain size and 0.07 of deviation coefficient of grain size distribution, in which 1 mol % of silver bromide based on all the grains was localized at the surface of the grains) in such an amount that each sensitizing dye is $2.0\times10^{-4}$ mol per mol of silver, and then by sulfur-sensitizing. The thus-prepared emulsion was mixed with and dissolved in the above-obtained emulsified dispersion to cive the composition shown below, thereby preparing the first-layer coating solution. Coating solutions for the second to seventh layers were also prepared in the same manner as in the first layer coating solution. As a gelatin hardener for the respective layers. 1-hydroxy-3,5-dichloro-s-triazine sodium salt was used.

As spectral-sensitizing dyes for the respective layers, the following compounds were used:

Blue-sensitive emulsion layer:

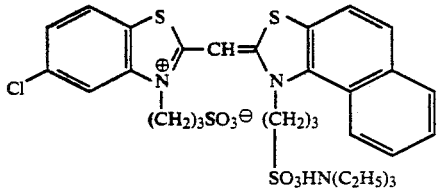

-continued

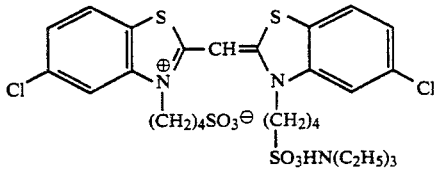

(The above two dyes were added each in an amount of $2.0\times10^{-4}$ mol per mol of silver halide.)

Green-sensitive emulsion layer:

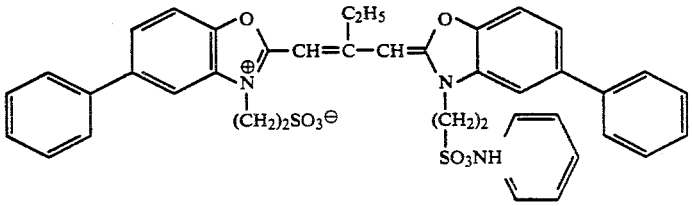

($4.0\times10^{-4}$ mol per mol of silver halide) and

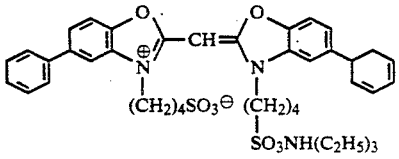

($7.0\times10^{-4}$ mol per mol of silver halide)

Red-sensitive emulsion layer:

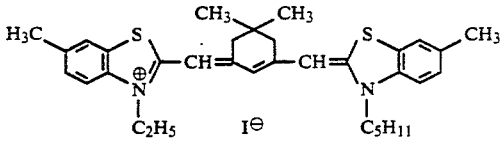

($0.9\times10^{-4}$ mol per mol of silver halide)

To the red-sensitive emulsion layer, the following compound was added in an amount of $2.6\times10^{-3}$ mol per mol of silver halide.

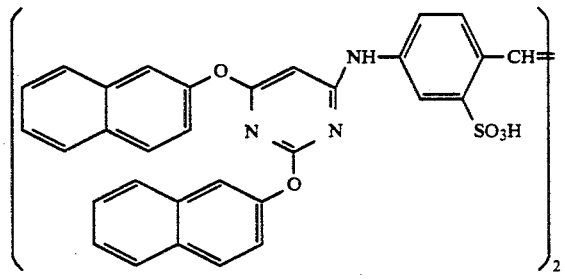

Further, 1-(5-methylureidophenyl)-5-mercaptotetrazole was added to the blue-sensitive emulsion layer, the green-sensitive emulsion layer, and red-sensitive emulsion layer in amounts of $8.5\times10^{-5}$ mol, $7.7\times10^{-4}$ mol, and $2.5\times10^{-4}$ mol per mol of silver halide, respectively.

The following dyes were added to the emulsion layers to prevent irradiation.

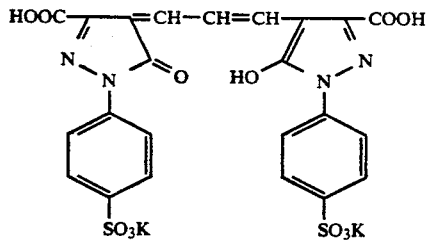

and

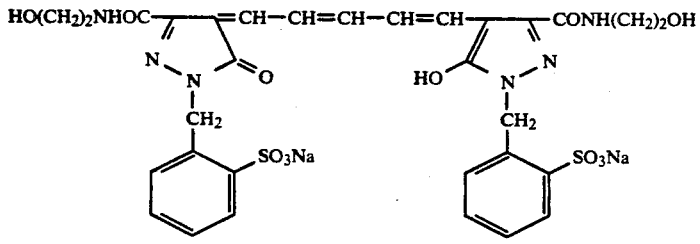

Composition of Layers

The composition of each layer is shown below. The figures represent coating amounts (g/m$^2$). The coating amounts of each silver halide emulsion is represented in terms of silver.

Base

Paper laminated on both sides with polyethylene (a white pigment, $TiO_2$, and a bluish dye, ultramarine, were included in the first layer side of the polyethylene-laminated film.)

First Layer: Blue-sensitive emulsion layer

The above-described silver chlorobromide

| | |
|---|---|
| emulsion | 0.30 |
| Gelatin | 1.86 |
| Yellow coupler (ExY) | 0.82 |
| Image-dye stabilizer (Cpd-1) | 0.19 |
| Image-dye stabilizer (Cpd-7) | 0.03 |
| Solvent (Solv-3) | 0.35 |

Second Layer: Color mix preventing layer

| | |
|---|---|
| Gelatin | 0.99 |
| Color mix inhibitor (Cpd-5) | 0.08 |
| Solvent (Solv-1) | 0.16 |
| Solvent (Solv-4) | 0.08 |

Third Layer: Green-sensitive emulsion layer

| | |
|---|---|
| Silver chlorobromide emulsion (cubic grains having 0.40 μm of average grain size and 0.08 of deviation coefficient of grain size distribution, in which 1 mol % of silver bromide based on all the grains was localized on the grain surface) | 0.20 |
| Gelatin | 1.24 |
| Magenta coupler (ExM) | 0.29 |
| Image-dye stabilizer (Cpd-3) | 0.09 |
| Image-dye stabilizer (Cpd-4) | 0.06 |
| Solvent (Solv-2) | 0.32 |

-continued

| | |
|---|---|
| Solvent (Solv-7) | 0.16 |

Fourth Layer: Ultraviolet ray absorbing layer

| | |
|---|---|
| Gelatin | 1.58 |
| Ultraviolet ray absorber (UV-1) | 0.47 |
| Color mix inhibitor (Cpd-5) | 0.05 |
| Solvent (Solv-5) | 0.24 |

Fifth Layer: Red-sensitive emulsion layer

| | |
|---|---|
| Silver chlorobromide emulsion (cubic grains having 0.36 μm of average grain size and 0.11 of deviation coefficient of grain size distribution, in which 1 mol % of silver bromide based on all the grains was localized on the grain surface) | 0.21 |
| Gelatin | 1.34 |
| Cyan coupler (ExC) | 0.34 |
| Image-dye stabilizer (Cpd-6) | 0.17 |
| Image-dye stabilizer (Cpd-7) | 0.34 |
| Image-dye stabilizer (Cpd-9) | 0.04 |
| Solvent (Solv-4) | 0.37 |

Sixth Layer: Ultraviolet ray absorbing layer

| | |
|---|---|
| Gelatin | 0.53 |
| Utraviolet ray absorber (UV-1) | 0.16 |
| Color-mix inhibitor (Cpd-5) | 0.02 |
| Solvent (Solv-5) | 0.08 |

Seventh Layer: Protective layer

| | |
|---|---|
| Gelatin | 1.33 |
| Acryl-modified copolymer of polyvinyl alcohol (Modification degree: 17%) | 0.17 |
| Liquid paraffin | 0.03 |

Compounds used are as follows:

(ExY) Yellow coupler
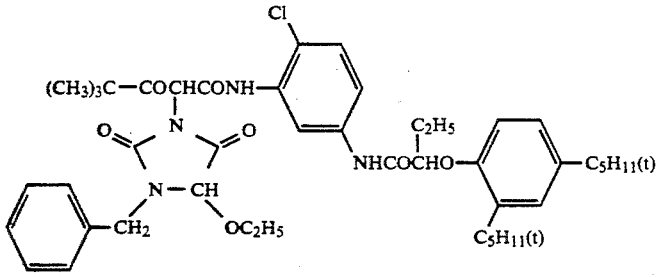
(ExM) Magenta coupler
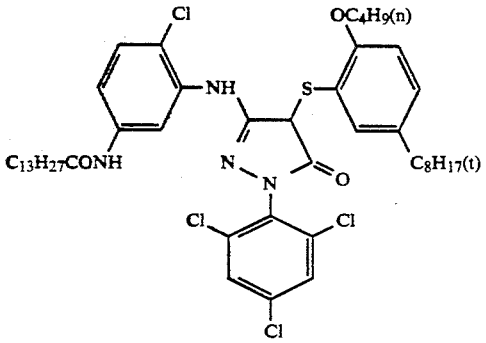
(ExC) Cyan coupler
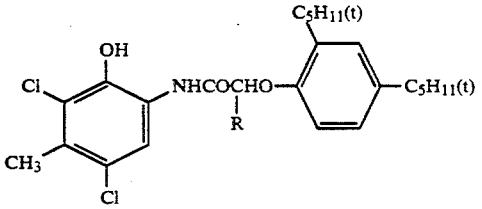
(mixture of R = H, $C_2H_5$, and $C_4H_9$ in weight ratio of 1:3:6)
(Cpd-1) Image-dye stabilizer
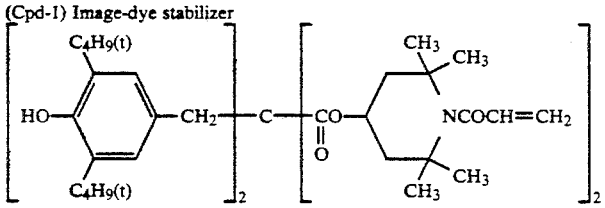
(Cpd-3) Image-dye stabilizer
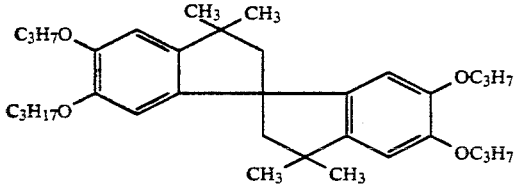
(Cpd-4) Image-dye stabilizer
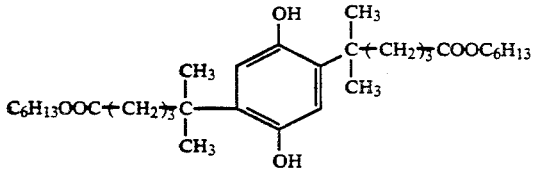
(Cpd-5) Color-mix inhibitor
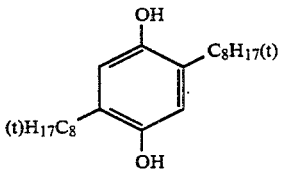
(Cpd-6) Image-dye stabilizer
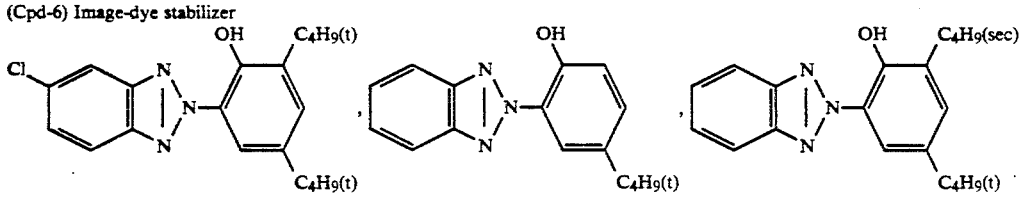
(mixture of 2:4:4 in weight ratio)
(Cpd-7) Image-dye stabilizer
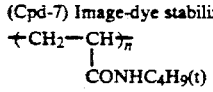
(average molecular weight: 60,000)

-continued (UV-1) Ultraviolet ray absorber

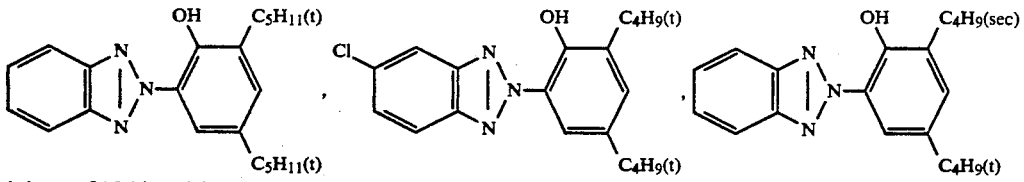

(mixture of 4:2:4 in weight ratio)

(Solv-1) Solvent

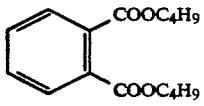

(Solv-2) Solvent

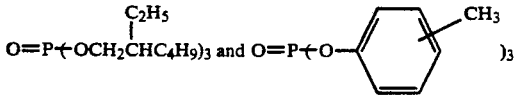

(mixture of 3:7 in volume ratio)

(Solv-3) Solvent

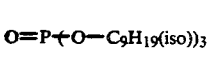

(Solv-4) Solvent

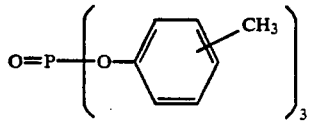

(Solv-5) Solvent

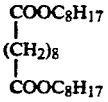

(Solv-6) Solvent

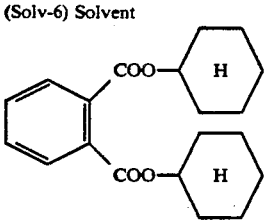

(Solv-7) Solvent

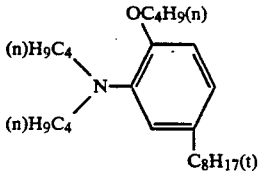

The thus-prepared sample is designated Sample 2-1.

Samples 2-2 to 2-14 were prepared in the same manner as Sample 2-1, except that the yellow coupler of the first layer, i.e., blue-sensitive emulsion layer, was changed to an equimolar yellow coupler of the present invention, as shown in Table 3.

The thus-prepared samples were subjected to an exposure to light in the same conditions as Example 1 and to the same processing as Example 1, except that the contents of sodium chloride and potassium bromide were 5.5 g/l and 12 mg/l, respectively.

Each density of yellow image-dyes obtained was measured to determine each Dmax. Results are shown in Table 3.

At the same time, the pressure-sensitized streaks were evaluated in the same manner as Example 1. Results are shown in Table 3.

TABLE 3

| Experiment NO. | Sample No. | Coupler | BL Dmax | Streaks | Remarks |
|---|---|---|---|---|---|
| 1 | 2-1 | (ExY) | 100 | ○ | Comparative Example |
| 2 | 2-2 | Y-1 | 127 | ○ | This Invention |
| 3 | 2-3 | Y-3 | 126 | ○ | " |
| 4 | 2-4 | Y-4 | 128 | ○ | " |
| 5 | 2-5 | Y-6 | 125 | ○ | " |
| 6 | 2-6 | Y-9 | 129 | ○ | " |
| 7 | 2-7 | Y-11 | 126 | ○ | " |
| 8 | 2-8 | Y-12 | 126 | ○ | " |
| 9 | 2-9 | Y-14 | 127 | ○ | " |
| 10 | 2-10 | Y-15 | 124 | ○ | " |
| 11 | 2-11 | Y-17 | 125 | ○ | " |
| 12 | 2-12 | Y-20 | 138 | ○ | " |
| 13 | 2-13 | Y-21 | 140 | ○ | " |
| 14 | 2-14 | Y-22 | 139 | ○ | " |

Taking the Dmax of the comparative coupler ExY as a standard (100), the ratio of the Dmax of each coupler to the standard was calculated to give it by percentage. (It indicates that the higher the numerical value, the higher the Dmax.)

As is apparent from the results in Table 3, in accordance with the present invention remarkably higher color-forming property was exhibited.

EXAMPLE 3

Samples of a photographic material are prepared in the same manner as Example 2, except that the coating amounts of silver in the first, third, and fifth layers were changed as shown in Table 4. In this case, the coating amounts of couplers per unit area were the same for every sample with only the coating amount of silver varied.

TABLE 4

| Photographic Material | Coating Amount of Silver ($g/m^2$) | | | |
|---|---|---|---|---|
| | BL | GL | RL | Total |
| 3-1 | 0.28 | 0.18 | 0.19 | 0.65 |
| 3-2 | 0.32 | 0.20 | 0.19 | 0.71 |
| 3-3 | 0.34 | 0.20 | 0.21 | 0.75 |
| 3-4 | 0.36 | 0.24 | 0.20 | 0.80 |
| 3-5 | 0.38 | 0.22 | 0.30 | 0.90 |

Next, samples 3-6 to 3-10 were prepared in the same manner as the above, except that the yellow coupler of the first layer, i.e., the blue-sensitive emulsion layer, was changed an equimolecular amount of yellow coupler (Y-11) of the present invention, respectively.

The thus-prepared photographic material samples were subjected to the same exposure to light as in Example 1, and a processing according to the following processing steps and processing solutions having the composition described below by an automatic processor.

| Processing step | Temperature | Time |
|---|---|---|
| Color Development | 37° C. | 45 sec. |
| Bleach-fixing | 30-36° C. | 45 sec. |
| Stabilizing (1) | 30-37° C. | 20 sec. |
| Stabilizing (2) | 30-37° C. | 20 sec. |
| Stabilizing (3) | 30-37° C. | 20 sec. |
| Stabilizing (4) | 30-37° C. | 30 sec. |
| Drying | 70-80° C. | 60 sec. |

(Stabilizing was carried out in 4-tanks countercurrent mode from the tank of stabilizing (4) toward the tank of stabilizing (1).)

-continued

| | |
|---|---|
| 5-Chloro-2-methyl-4-isothiazoline-3-one | 0.02 g |
| 2-Methyl-4-isothiazoline-3-one | 0.01 g |
| Copper sulfate | 0.005 g |
| Water to make | 1000 ml |
| pH (25° C.) | 4.0 |

After processing, each sample was subjected to the same measurements as in Example 1 to determine Dmax, Dmin, and pressure-sensitized streaks, and then the residual amount of silver was determined by a fluorescent X-ray method.

The results are shown in Table 5.

TABLE 5

| Process No. | Sample No. | Halide Ion Concentration in Developer (mol/l) $Cl^-$ | $Br^-$ | BL Dmin | Dmax | Residual Silver ($\mu g/cm^2$) | Pressure-sensitized Streak | Remarks |
|---|---|---|---|---|---|---|---|---|
| 301 | 3-1 | $4.0 \times 10^{-2}$ | $1.0 \times 10^{-4}$ | 0.12 | 2.04 | 0.4 | ○ | Comparative Example |
| 302 | 3-2 | $4.0 \times 10^{-2}$ | $1.0 \times 10^{-4}$ | 0.12 | 2.11 | 0.8 | ○ | " |
| 303 | 3-3 | $4.0 \times 10^{-2}$ | $1.0 \times 10^{-4}$ | 0.13 | 2.20 | 1.3 | ○ | " |
| 304 | 3-4 | $4.0 \times 10^{-2}$ | $1.0 \times 10^{-4}$ | 0.16 | 2.31 | 3.8 | X | " |
| 305 | 3-5 | $4.0 \times 10^{-2}$ | $1.0 \times 10^{-4}$ | 0.18 | 2.39 | 6.9 | XX | " |
| 306 | 3-6 | $3.0 \times 10^{-1}$ | $1.0 \times 10^{-2}$ | 0.11 | 2.08 | 0.4 | ○ | " |
| 307 | 3-7 | $3.0 \times 10^{-1}$ | $1.0 \times 10^{-2}$ | 0.12 | 2.19 | 0.9 | ○ | " |
| 308 | 3-8 | $3.0 \times 10^{-1}$ | $1.0 \times 10^{-2}$ | 0.12 | 2.26 | 1.2 | ○ | " |
| 309 | 3-9 | $3.0 \times 10^{-1}$ | $1.0 \times 10^{-2}$ | 0.13 | 2.39 | 4.0 | X | " |
| 310 | 3-10 | $3.0 \times 10^{-1}$ | $1.0 \times 10^{-2}$ | 0.13 | 2.48 | 7.0 | XX | " |
| 311 | 3-6 | $3.5 \times 10^{-3}$ | $3.0 \times 10^{-6}$ | 0.11 | 2.47 | 0.4 | X | " |
| 312 | 3-7 | $3.5 \times 10^{-3}$ | $3.0 \times 10^{-6}$ | 0.12 | 2.52 | 0.9 | X | " |
| 313 | 3-8 | $3.5 \times 10^{-3}$ | $3.0 \times 10^{-6}$ | 0.13 | 2.59 | 0.9 | X | " |
| 314 | 3-9 | $3.5 \times 10^{-3}$ | $3.0 \times 10^{-6}$ | 0.16 | 2.60 | 4.2 | XX | " |
| 315 | 3-10 | $3.5 \times 10^{-3}$ | $3.0 \times 10^{-6}$ | 0.18 | 2.61 | 8.0 | XX | " |
| 316 | 3-6 | $4.0 \times 10^{-2}$ | $1.0 \times 10^{-4}$ | 0.11 | 2.46 | 0.4 | ○ | This Invention |
| 317 | 3-7 | $4.0 \times 10^{-2}$ | $1.0 \times 10^{-4}$ | 0.12 | 2.48 | 0.9 | ○ | " |
| 318 | 3-8 | $4.0 \times 10^{-2}$ | $1.0 \times 10^{-4}$ | 0.12 | 2.51 | 1.2 | ○ | " |
| 319 | 3-9 | $4.0 \times 10^{-2}$ | $1.0 \times 10^{-4}$ | 0.16 | 2.59 | 3.6 | X | Comparative Example |
| 320 | 3-10 | $4.0 \times 10^{-2}$ | $1.0 \times 10^{-4}$ | 0.18 | 2.60 | 4.9 | XX | " |
| 321 | 3-6 | $3.5 \times 10^{-2}$ | $1.0 \times 10^{-4}$ | 0.12 | 2.51 | 0.9 | ○ | This Invention |
| 322 | 3-6 | $3.5 \times 10^{-2}$ | $1.0 \times 10^{-3}$ | 0.11 | 2.45 | 0.9 | ○ | " |
| 323 | 3-6 | $3.5 \times 10^{-2}$ | $8.0 \times 10^{-4}$ | 0.11 | 2.47 | 0.9 | ○ | " |
| 324 | 3-6 | $3.5 \times 10^{-2}$ | $5.0 \times 10^{-4}$ | 0.11 | 2.49 | 0.9 | ○ | " |

The composition of the respective processing solution were as follows:

| | |
|---|---|
| Color developer | |
| Water | 800 ml |
| Ethylenediaminetetraacetic acid | 2.0 g |
| Triethanolamine | 8.0 g |
| Sodium chloride | see Table 5 |
| Potassium bromide | see Table 5 |
| Potassium carbonate | 25 g |
| N-Ethyl-N-(β-methanesulfonamidoethyl)-3-methyl-4-aminoaniline sulfate | 5.0 g |
| N,N-Bis(carboxymethyl)hydrazine | 7.0 g |
| 5,6-Dihydroxybenzene-1,2,4-trisulfonate | 0.3 g |
| Fluorescent brightening agent (WHITEX-4, made by Sumitomo Chemical Industries, 4,4'diamino-stilbene series) | 2.0 g |
| Sodium sulfite | 0.1 g |
| Water to make | 1000 ml |
| pH (25° C.) | 10.10 |
| Bleach-fixing solution | |
| Water | 400 ml |
| Ammonium thiosulfate (70%) | 100 ml |
| Sodium sulfite | 18 g |
| Iron (III) ammonium ethylenediaminetetraacetate | 55 g |
| Disodium ethylenediaminetetraacetate | 3 g |
| Glacial acetic acid | 8 g |
| Water to make | 1000 ml |
| pH (25° C.) | 5.5 |
| Stabilizing solution | |
| Formalin (37%) | 0.1 g |
| Formalin-sulfurous acid adduct | 0.7 g |

As is apparent from the results in Table 5, only the cases when the halide ion concentrations in the color developer were in the specified ranges of the present invention, and the photographic materials were those employing the coupler of the present invention and having a total coating amount of silver of 0.75 g/cm² or below, were excellent with respect to Dmax, bleach ability, and pressure-sensitized streaks (Sample Nos. 316 to 318 and 321 to 324). That is, Sample Nos. 301 to 303, which were different only in the yellow coupler, were poor in color-forming property, while Sample Nos. 306 to 308, whose halide ion concentrations were outside the specified ranges, were poor in Dmax. Sample Nos. 311 to 313, wherein the halide ion concentrations in the developer were low, were poor with respect to pressure-sensitized streaks. Sample Nos. 304, 305, 309, 310, 314, 315, 319, and 320, wherein the total coating amount of silver was large, were very poor with respect to pressure-sensitized streaks, Dmax, and bleach ability.

It can be understood that, by carrying out the present invention, the problem of pressure-sensitized streaks could be solved without deteriorating other performances, and the bleach ability was also improved as is apparent from the comparison of Sample Nos. 316 to 318 with Sample Nos. 301 to 303, 306 to 308, and 311 to 313, which results are unexpected.

EXAMPLE 4

Photographic material Samples 2-1, 2-2, 2-4, 2-10, and 2-13 that had been prepared in Example 2 were subjected to an imagewise exposure to light through an optical wedge and to running processing according to the conditions as described below, until the replenisher amount reached 2-times the tank volume.

| | Processing steps | | | |
|---|---|---|---|---|
| Step | Temperature | Time | Replenisher Amount* | Tank Volume |
| Color Development | 38° C. | 45 sec. | 75 ml | 4 l |
| Bleach-fixing | 30–36° C. | 45 sec. | 215 ml | 4 l |
| Stabilizing (1) | 30–37° C. | 0 sec. | — | 2 l |
| Stabilizing (2) | 30–37° C. | 0 sec. | — | 2 l |
| Stabilizing (3) | 30–37° C. | 0 sec. | 250 ml | 2 l |
| Drying | 70–85° C. | 60 sec. | | |

Note *Replenisher amount per 1 $m^2$ of the photographic material
(Stabilizing was carried out in 3-tanks countercurrent mode from the tank of stabilizing (3) toward the tank of stabilizing (1).)

The composition of the respective processing solution were as follows:

| | Tank solution | Replenisher |
|---|---|---|
| Color developer | | |
| Water | 800 ml | 800 ml |
| Ethylenediaminetetraacetic acid | 5.0 g | 5.0 g |
| 5,6-Dihydroxybenzene-1,2,4-trisulfonic acid | 0.3 g | 0.3 g |
| Triethanolamine | 8.0 g | 8.0 g |
| Sodium chloride | $5.3 \times 10^{-2}$ mol | — |
| Potassium bromide | $1.2 \times 10^{-4}$ mol | — |
| Potassium carbonate | 25 g | 25 g |
| N-Ethyl-N-(β-methanesulfonamidoethyl)-3-methyl-4-aminoaniline sulfate | 5.0 g | 15.0 g |
| Fluorescent brightening agent (WHITEX-4, made by Sumitomo Chemical Industries) | 1.0 g | 3.0 g |
| Water to make | 1000 ml | 1000 ml |
| pH (25° C.) | 10.05 | 10.65 |
| Bleach-fixing solution (Both tank solution and replenisher are the same) | | |
| Water | | 400 ml |
| Ammonium thiosulfate (70%) | | 100 ml |
| Sodium sulfite | | 17 g |
| Iron (III) ammonium ethylenediaminetetraacetate | | 55 g |
| Disodium ethylenediaminetetraacetate | | 5 g |
| Glacial acetic acid | | 9 g |
| Water to make | | 1000 ml |
| pH (25° C.) | | 5.40 |
| Stabilizing solution (Both tank solution and replenisher are the same) | | |
| Formalin (37%) | | 0.1 g |
| Formalin-sulfurous acid adduct | | 0.7 g |
| 5-Chloro-2-methyl-4-isothiazoline-3-one | | 0.02 g |
| 2-Methyl-4-isothiazoline-3-one | | 0.01 g |
| Copper sulfate | | 0.005 g |
| Water to make | | 1000 ml |
| pH (25° C.) | | 4.0 |

Photographic properties were designated by two properties, that is, minimum density (Dmin) and maximum density (Dmax). Results are shown in Table 6.

TABLE 6

| Photographic Material | Photographic Property: Fresh Solution Dmin | Fresh Solution Dmax | Running Solution Dmin | Running Solution Dmax | Remarks |
|---|---|---|---|---|---|
| 2-1 | 0.13 | 2.42 | 0.16 | 1.98 | Comparative |

TABLE 6-continued

| Photographic Material | Photographic Property: Fresh Solution Dmin | Fresh Solution Dmax | Running Solution Dmin | Running Solution Dmax | Remarks |
|---|---|---|---|---|---|
| | | | | | Example |
| 2-2 | 0.12 | 2.43 | 0.12 | 2.41 | This Invention |
| 2-4 | 0.12 | 2.41 | 0.12 | 2.39 | " |
| 2-10 | 0.12 | 2.42 | 0.13 | 2.40 | " |
| 2-13 | 0.16 | 2.61 | 0.18 | 2.57 | " |

As is apparent from the results in Table 6, the method of the present invention exhibits excellent photographic properties, even in processing with a remarkably decreased replenishing amount. It is added that according to the method of the present invention no pressure-sensitized streak was noticed.

Having described our invention as related to the embodiment, it is our intention that the invention be not limited by any of the details of the description, unless otherwise specified, but rather be construed broadly within its sprit and scope as set out in the accompanying claims.

What we claim is:

1. In a method for processing an image-wise exposed silver halide color photographic material with a color developer that contains at least one aromatic primary amine color-developing agent, the improvement comprising:

processing said image-wise exposed silver halide color photographic material including a layer containing a silver halide emulsion comprising 80 mol % or over of silver chloride and at least one yellow coupler represented by the following formula (I)

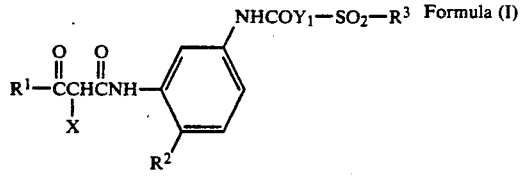

Formula (I)

wherein $R^1$ represents a tertiary alkyl group or an aryl group, $R^2$ represents a halogen atom or an alkoxy group, $R^3$ represents an alkyl group or an aryl group, $Y_1$ represents a divalent linking group, and X represents a coupling split-off group, said photographic material having a total coated silver of 0.75 g/$m^2$ or below, with said color developer containing chloride ions in an amount of $3.5\times10^{-2}$ to $1.5\times10^{-1}$ mol/l, and bromide ions in an amount of $3.0\times10^{-5}$ to $1.0\times10^{-3}$ mol/l.

2. The method as claimed in claim 1, wherein $R^1$ in formula (I) is a tertiary butyl group or an unsubstituted or substituted phenyl group.

3. The method as claimed in claim 1, wherein $R^2$ in formula (I) is a chlorine atom or an alkoxy group.

4. The method as claimed in claim 1, wherein $R^3$ in formula (I) is selected from the group consisting of n-octyl, n-dodecyl, n-heptadecyl, and a phenyl group.

5. The method as claimed in claim 1, wherein $Y_1$ in formula (I) is a divalent organic group represented by the following formula (I-a):

-A-V-B- Formula (I-a)

wherein A and B each represent an alkylene group, an arylene group, or an aralkylene group, and V represents a divalent crosslinking group.

6. The method as claimed in claim 1 wherein X in formula (I) is a coupling split-off group to form a two-equivalent yellow coupler, represented by the following formula (a), (b), or (c):

Formula (a)

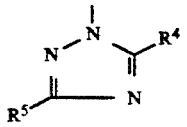

Formula (b)

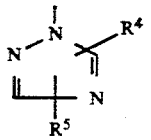

wherein $R^4$ and $R^5$, which may be the same or different, each represent a hydrogen atom, a halogen atom, a carboxylic acid ester group, an amino group, an alkyl group, an alkylthio group, an alkoxy group, an alkylsulfonyl group, an alkylsulfinyl group, a carboxylic acid group, a sulfonic acid group, a substituted or unsubstituted phenyl group, or a heterocyclic group, Formula (c)

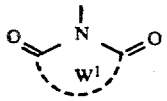

wherein $W^1$ represents a group of nonmetal atoms required to form a 4-, 5-, or 6-membered ring together with

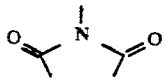

in the formula.

7. The method as claimed in claim 1, wherein X in formula (I) is a coupling split-off group to form a two-equivalent yellow coupler represented by the following formula (d), (e), or (f):

Formula (d)

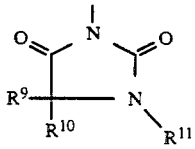

Formula (e)

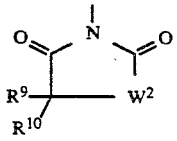

Formula (f)

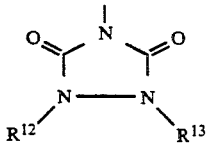

wherein $R^9$, and $R^{10}$ each represent a hydrogen atom, an alkyl group, an aryl group, an alkoxy group, an aryloxy group, or a hydroxy group, $R^{11}$, $R^{12}$, and $R^{13}$ each represent a hydrogen atom, an alkyl group, an aryl group, an aralkyl group, or an acyl group, and $W^2$ represents an oxygen atom or a sulfur atom.

8. The method as claimed in claim 1, wherein the content of silver chloride in the silver halide emulsion is 95 mol % or over.

9. The method as claimed in claim 1, wherein the content of silver iodide in the silver halide emulsion is 0.2 mol % or below.

10. The method as claimed in claim 1, wherein the content of chloride ions in the color developer is $4.0\times10^{-2}$ to $1.0\times10^{-1}$ mol/l.

11. The method as claimed in claim 1, wherein the color developer contains benzyl alcohol in an amount of 2.0 ml or below per liter of the developer.

12. The method as claimed in claim 1, wherein the color developer contains an organic preservative.

13. The method as claimed in claim 1, wherein said processing with a color developer occurs in a processing time of 20 seconds to 5 minutes.

14. The method as claimed in claim 1, wherein the color developer is replenished with a replenisher and the replenishing amount of the color developer is 20 to 150 ml per square meter of the photographic material.

15. The method as claimed in claim 1, wherein the bromide ion concentration is from $5.0\times10^{-5}$ to $5.0\times10^{-4}$ mols/l.

16. The method as claimed in claim 15, wherein the content of chloride ions in the color developer is $4.0\times10^{-2}$ to $1.0\times10^{-1}$ mol/l.

* * * * *